US009050845B2

(12) United States Patent
Kimura

(10) Patent No.: US 9,050,845 B2
(45) Date of Patent: Jun. 9, 2015

(54) PRINTING SYSTEM, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventor: Hiromi Kimura, Kawasaki (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/096,103

(22) Filed: Dec. 4, 2013

(65) Prior Publication Data

US 2014/0154030 A1 Jun. 5, 2014

(30) Foreign Application Priority Data

Dec. 4, 2012 (JP) ..... 2012-265174

(51) Int. Cl.

| | |
|---|---|
| ***B42B 4/00*** | (2006.01) |
| ***B65H 37/04*** | (2006.01) |
| ***B42C 1/12*** | (2006.01) |
| ***G03G 15/00*** | (2006.01) |
| *B42B 2/02* | (2006.01) |
| *B42C 5/00* | (2006.01) |

(52) U.S. Cl.

CPC *B42B 4/00* (2013.01); *B65H 37/04* (2013.01); *G03G 2215/00831* (2013.01); *B42B 2/02* (2013.01); *B42C 1/12* (2013.01); *B42C 5/00* (2013.01); *G03G 15/6544* (2013.01); *G03G 2215/00936* (2013.01)

(58) Field of Classification Search

CPC ..... B31F 5/003; B65H 45/28; B65H 37/04; B42C 1/12; G03G 2215/00831

USPC ..... 270/32, 52.17, 52.18, 52.19, 58.07, 270/58.08; 412/13, 16

See application file for complete search history.

(56) References Cited

U.S. PATENT DOCUMENTS

| | | | | |
|---|---|---|---|---|
| 4,891,681 | A * | 1/1990 | Fiske et al. | 399/385 |
| 8,424,861 | B2 * | 4/2013 | Buchel | 270/52.3 |
| 8,523,164 | B2 * | 9/2013 | Tassinari | 270/52.19 |
| 8,616,541 | B2 * | 12/2013 | Hayashi | 270/21.1 |

FOREIGN PATENT DOCUMENTS

| | | | |
|---|---|---|---|
| JP | 2007-001119 | A | 1/2007 |
| JP | 2010-168134 | A | 8/2010 |
| WO | WO 2010090770 | A1 * | 8/2010 |

* cited by examiner

*Primary Examiner* — Leslie A Nicholson, III

(74) *Attorney, Agent, or Firm* — Rossi, Kimms & McDowell LLP

(57) ABSTRACT

A printing system that is capable of producing a bookbound matter with good appearance when producing the bookbound matter by covering a first sheet bundle with a second sheet bundle. A determination unit determines whether it is specified so that images are printed on sheets of first and second sheet bundles in page order in which a bookbound matter is produced by covering the second sheet bundle folded by the first sheet bundle folded. A control unit controls so as to cut the first sheet bundle at a first position and to cut the second sheet bundle at a second position that is different from the first position, when the determination unit determines to be specified.

7 Claims, 26 Drawing Sheets

FIG. 18C

2203

DETAILS OF BOOKBINDING

PROCESSING METHOD OF BOOKBINDING AND PRINTING (K)

- ○ PROCESSING BY APPLICATION
- ○ PROCESSING BY DRIVER
- ◉ PROCESSING BY DEVICE

METHOD OF BOOKBINDING AND PRINTING (B)

- ◉ PRINT ALL PAGES AT ONCE
- ○ SEPARATE PAGES INTO SOME BUNDLES AND PRINT FOR EACH BUNDLE

SHEET NUMBER PER BUNDLE (S): 16 SHEET (1-16)

OPENING DIRECTION (O) OPEN FROM RIGHT TO LEFT

☐ SPECIFY BINDING MARGIN (G)

BINDING MARGIN (L) 10 mm (0-50)

☐ USE CREEP (DEVIATION) CORRECTION FUNCTION (U)

CORRECTION METHOD (D)

- ◉ USE DEVICE SETTING
- ○ AUTO CORRECTION
- ○ MANUAL CORRECTION

CORRECTION AMOUNT (C): 0.00 mm (0.00-10.00)

OK CANCEL HELP

PRINTING SYSTEM, CONTROL METHOD THEREFOR, AND STORAGE MEDIUM STORING CONTROL PROGRAM THEREFOR

BACKGROUND OF THE INVENTION

1. Field of the Invention

The present invention relates to a printing system that allows detail settings about bookbinding processes, such as a separation process, a saddle stitching process, and a cutting process, a control method therefor, and a storage medium storing a control program therefor.

2. Description of the Related Art

In a simple bookbinding process, a saddle stitch bookbinding method, which binds a book by stapling the center of a sheet bundle and folding it in half, is commonly used. This method is used for binding a magazine etc. The maximum number of sheets that can be bound by saddle stitching is defined by ability of a post-processing device. In order to bind a book that consists of sheets of which the number exceeds the ability of the post-processing device, it is necessary to separate the sheets into sections each of which does not exceed the maximum sheet number of the post-processing device, to bind each of the sections, and to further gather all the sections. This is called separation bookbinding.

Moreover, there is a method for adjusting an image forming position beforehand to prevent an image deviation for every page that occurs due to thickness of a sheet after a bookbinding process, and for trimming each section (separated sheet bundle) with a fixed cutting width to true up an edge of a printed matter (a bookbound matter) made with the bookbinding process (for example, see Japanese Laid-Open Patent Publication (Kokai) No. 2007-1119 (JP 2007-1119A)).

On the other hand, there are many two-folded printed matters (fliers) distributed without stitching sheets. The maximum number of sheets that can be folded at once without stitching is defined by ability of the post-processing device. Accordingly, there is a known method of automatically dividing sheets into bundles each of which contains sheets no more than the sheet number specified by an operator or the maximum number of sheets that can be folded by a post-processing device (for example, see Japanese Laid-Open Patent Publication (Kokai) No. 2010-168134 (JP 2010-168134A)). Moreover, a post-processing device that is capable of cutting sheets collectively even in no stitching state is appearing in recent years.

However, the method of JP 2007-1119A designed for the saddle stitch bookbinding cannot adjust an image forming position to prevent an image deviation for every page to a divided sheet bundle without stitching, and cannot form a printed matter by cutting such a sheet bundle after a bookbinding process. That is, since stitched sheet bundles (sections) are stacked as-is with a stacking process in a case of saddle stitch bookbinding, the edges of sheets are trued up by trimming every bundle with a fixed cutting width. On the other hand, since a two-folded flier that is distributed without the saddle stitching is formed so that an operator inserts an inside bundle into an outside bundle that are processed divisionally (an insertion process), there is a problem that the edge positions of the respective bundles are deviated when the bundles are trimmed with the fixed cutting width.

SUMMARY OF THE INVENTION

The present invention provides a printing system, a control method therefor, and a storage medium storing a control program therefor, which are capable of producing a bookbound matter (a printed matter) with good appearance when producing the bookbound matter by covering a first sheet bundle with a second sheet bundle.

Accordingly, a first aspect of the present invention provides a printing system comprising a determination unit configured to determine whether it is specified so that images are printed on sheets of first and second sheet bundles in page order in which a bookbound matter is produced by covering the second sheet bundle folded with the first sheet bundle folded; and a control unit configured to control so as to cut the first sheet bundle at a first position and to cut the second sheet bundle at a second position that is different from the first position, when the determination unit determines to be specified.

Accordingly, a second aspect of the present invention provides a control method for a printing system comprising determining whether it is specified so that images are printed on sheets of first and second sheet bundles in page order in which a bookbound matter is produced by covering the second sheet bundle folded with the first sheet bundle folded, and controlling so as to cut the first sheet bundle at a first position and to cut the second sheet bundle at a second position that is different from the first position, when determining to be specified.

Accordingly, a third aspect of the present invention provides a non-transitory computer-readable storage medium storing a control program causing a computer to execute a control method for a printing system, the program comprising a code for determining whether it is specified so that images are printed on sheets of first and second sheet bundles in page order in which a bookbound matter is produced by covering the second sheet bundle folded with the first sheet bundle folded; and a code for controlling so as to cut the first sheet bundle at a first position and to cut the second sheet bundle at a second position that is different from the first position, when determining to be specified.

The present invention enables to adjust the image forming positions to prevent the image deviations for the respective pages and to adjust the cutting position to a printed matter after the bookbinding process according to the separation process with respect to sheet bundles divided without saddle stitching. Thereby, even if an operator forms a printed matter by performing the insertion process to sheet bundles after the cutting process, the image positions on the pages and the deviation of cutting positions of the respective sheet bundles can be prevented, which enables to provide a printed matter of which the edges are trued up.

Further features of the present invention will become apparent from the following description of exemplary embodiments with reference to the attached drawings.

BRIEF DESCRIPTION OF THE DRAWINGS

FIG. 18A through FIG. 18C are views showing examples of operation screens displayed on a host computer shown in FIG. 1 for generating a print job.

DESCRIPTION OF THE EMBODIMENTS

Hereafter, embodiments according to the present invention will be described in detail with reference to the drawings.

Figure 1:
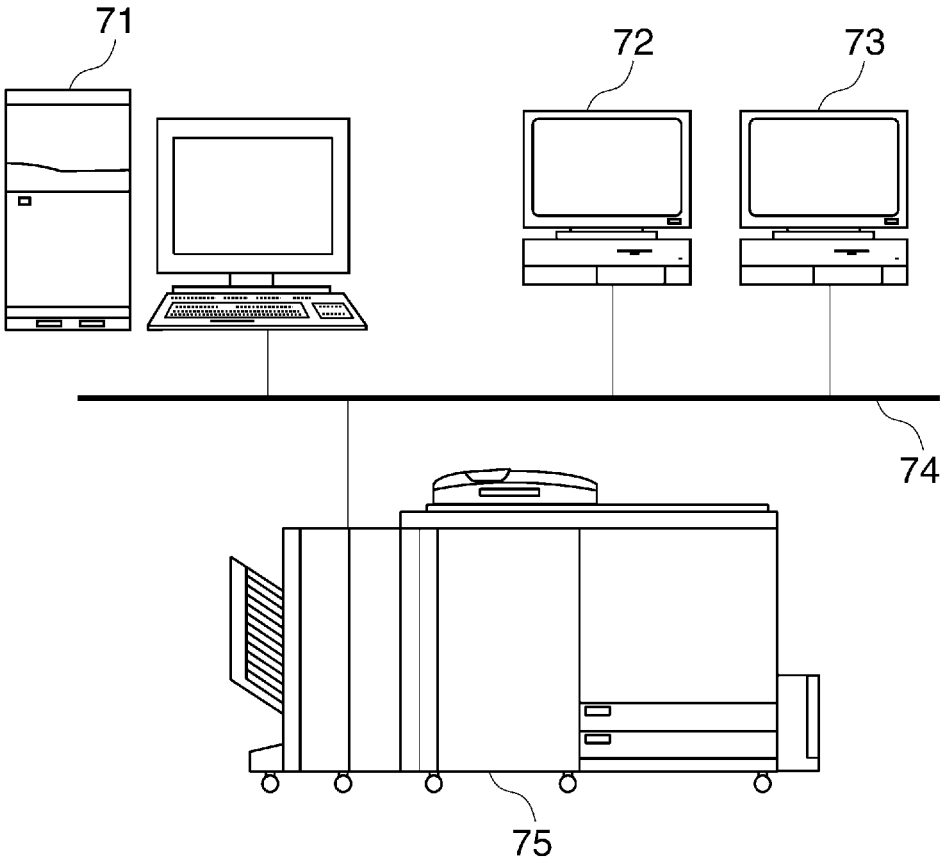
FIG. 1 is a view showing an example of network environment containing a printing system according to a first embodiment of the present invention.

FIG. 1 is a view showing an example of network environment containing a printing system according to a first embodiment of the present invention.

As shown in FIG. 1, a printing system 75 is connected to a print server 71 and host computers 72 and 73 via a network 74.

The print server 71 monitors a state of a print job executed by the printing system 75, is capable of stopping an executing print job temporally and restarting the stopped print job, and is capable of changing, copying, moving, and deleting a setting of a print job. The host computers 72 and 73 can generate print jobs supplied to the printing system 75.

Figure 2:
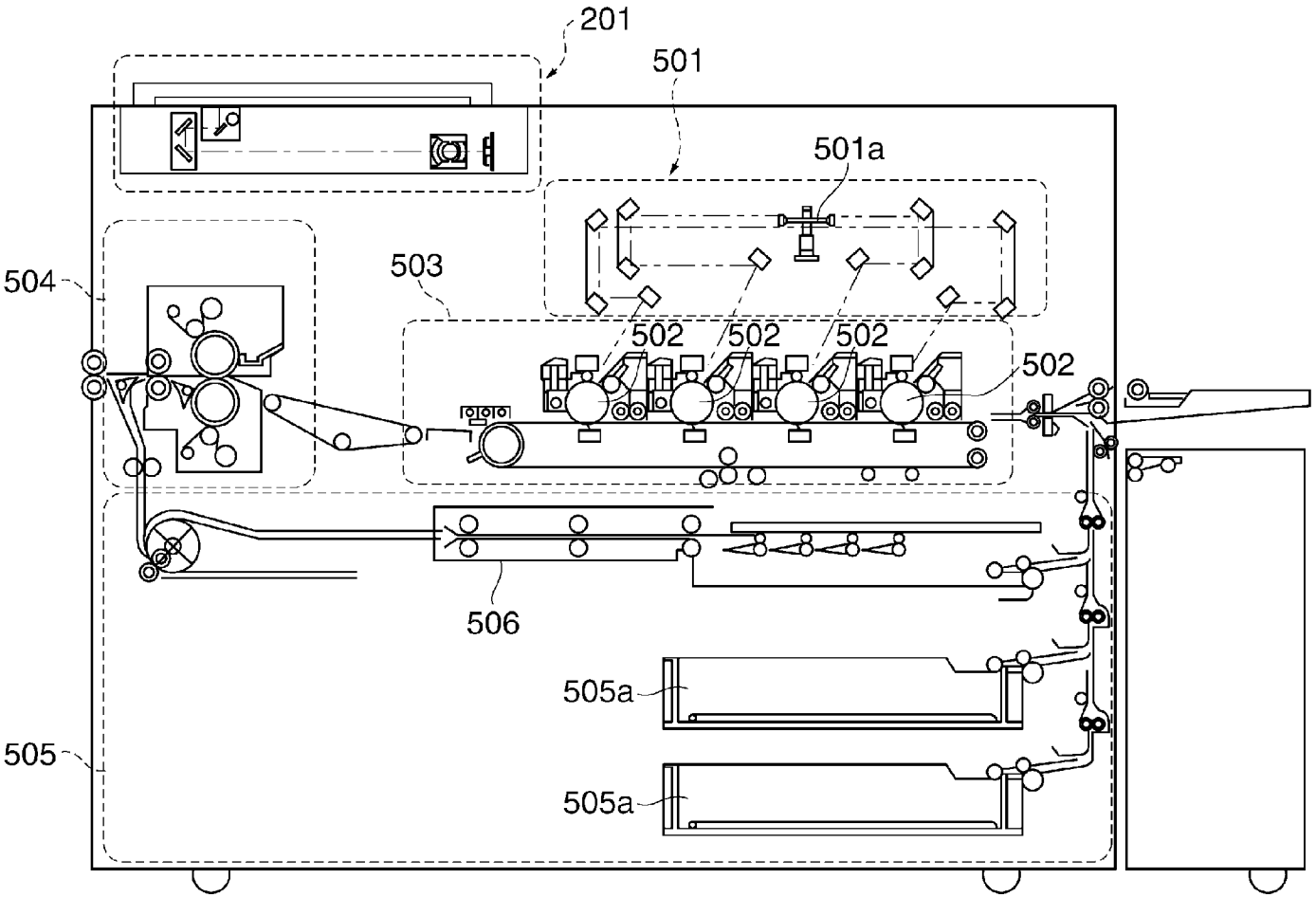
FIG. 2 is a sectional view schematically showing an internal configuration of an image forming apparatus that constitutes the printing system shown in FIG. 1.

FIG. 2 is a sectional view schematically showing an internal configuration of an image forming apparatus that constitutes the printing system 75 shown in FIG. 1.

The illustrated image forming apparatus is a digital multifunctional peripheral device of a 4D color system, and consists of a scanner unit 201, a laser exposure unit 501, an image forming unit 503 that includes photosensitive drums 502, a fixing unit 504, a feeding/conveying unit 505, and a printer control unit (not shown) that controls the above-mentioned units.

The scanner unit 201 illuminates an original put on a platen glass and reads an original image optically, and converts the original image read into an electrical signal to generate image data. The laser exposure unit 501 makes laser beams modulated according to the image data impinge on a rotational polygonal mirror (polygon mirror) 501*a* that rotates at constant angular velocity, and irradiates the photosensitive drums 502 with scanning beams reflected by the polygon mirror 501*a*.

The image forming unit 503 rotates the photosensitive drums 502, electrifies them with electrostatic chargers, develops latent images formed on the photosensitive drums 502 by the laser exposure unit 501 with toner, and transfers toner images on a sheet. Furthermore, the image forming unit 503 collects minute toner that is remained on the photosensitive drums 502 without being transferred. Thus, the image forming section 503 forms an image with four development units (development stations) that execute an electrophotography process. The four development units are aligned in order of Cyan (C), magenta (M), yellow (Y), and black (K), and sequentially execute image forming operations of magenta, yellow, and black after elapsing specified time from the image formation start of cyan. This timing control enables to transfer a full color toner image on a sheet without color misregistration.

The fixing unit 504 is provided with a roller, a belt, and a heat source like a halogen heater, and fixes the toner image transferred on a sheet by the image forming unit 503 by melting the toner image with heat and pressure.

The feeding/conveying unit 505 has one or more sheet storage sheds 505*a*, such as sheet cassettes and paper decks. Then, the feeding/conveying unit 505 separates one sheet from a plurality of sheets stored in one of the sheet storage sheds 505*a* according to an instruction from the printer control unit, and conveys it to the image forming unit 503. Toner images of the respective colors are transferred to the sheet conveyed with the four development units, and finally a full color toner image is formed on the sheet. When forming images on both sides of a sheet, the sheet that passed the fixing unit 504 is guided to a double-sided conveyance path 506 that again conveys a sheet to the image forming unit 503.

The printer control unit (not shown) communicates with a main control unit (not shown), which controls the whole image forming apparatus, and executes a control according to an instruction from the main control unit. Furthermore, the printer control unit manages the states of the scanner unit 201, the laser exposure unit 501, the image forming unit 503, the fixing unit 504, and the feeding/conveying unit 505, and controls these units so that all the units operate smoothly in consonance with each other.

Next, operations of the respective units from a power OFF state of the image forming apparatus until reaching an operation startable state will be described briefly.

When the power of the image forming apparatus is turned ON, the printer control unit instructs the scanner unit 201, the laser exposure unit 501, the image forming unit 503, the fixing unit 504, and the feeding/conveying unit 505 to start preparing operations. Then, the printer control unit waits until the communication with the main control unit, which manages the whole image forming apparatus, starts. When the communication with the main control unit is established, the control units exchange specifications mutually. Then, when the preparing operations are finished and the image forming operation becomes available, the printer control unit notifies the main control unit of an operatable state.

The printer control unit notifies the main control unit of the states of the units. For example, the feeding/conveying unit 505 detects the sizes of the sheets stored in the sheet storage sheds 505*a*, the remaining amounts (loads) of the sheets, and the operating states (available or failed) of driving units, and notifies the main control unit of these detected results. Moreover, the image forming unit 503 notifies the main control unit of the remaining toner amounts of toner recovery containers.

Next, operations of the respective units from a time point when the image forming apparatus is able to start operations until a series of print operations, which are executed in response to a notification of an operation instruction from the main control unit, are finished will be described briefly.

The main control unit notifies the printer control unit of an operation start command. When receiving the operation start command, the printer control unit instructs the laser exposure unit 501, the image forming unit 503, the feeding/conveying unit 505, and the fixing unit 504 to start a print operation. The laser exposure unit 501 starts rotating a motor that drives the polygon mirror 501*a*. Then, the image forming unit 503 rotates the photosensitive drums 502, and electrifies the photosensitive drums 502. The fixing unit 504 turns the fixing heater ON to heat a fixing roller up to a fixing temperature at which toner is fixed to a sheet. Then, the feeding/conveying unit 505 brings a drive motor to a conveyance available state.

When the operations of the respective units are prepared, the printer control unit sends a ready notification to the main control unit. When receiving the ready notification, the main control unit instructs a print operation by unit of page. The main control unit instructs the print operation of 200 pages for a print job that prints 20 copies of printed matter of 10 pages, for example. When receiving the instruction of the print operation, the print control unit instructs the feeding/conveying unit 505 to feed a sheet.

The feeding/conveying unit 505 conveys a sheet when it can be supplied, and notifies the print control unit of an arrival of sheet when the sheet arrives at a specified position. If there is no sheet in the sheet storage sheds 505*a*, the print control unit is notified that a sheet cannot be fed. Moreover, the feeding/conveying unit 505 may have a multi-feeding detection sensor that detects a multi feeding state of sheets on a conveyance path, a thickness detection sensor that detects thickness of sheets, etc. If these sensors detect a multi feeding state or an anomaly, the feeding/conveying unit 505 interrupts the sheet feeding operation and the conveying operation, and notifies the print control unit of the anomaly. When receiving the anomaly notification, the print control unit notifies the main control unit of a reason why the operation was interrupted and a position of sheet that remains in the apparatus, etc.

When the print control unit is notified that the sheet was conveyed normally and was arrived at the specified position, the print control unit instructs the image forming unit 503 to start an image formation according to the notification. This timing control enables to transfer a toner image onto the sheet. On the other hand, the fixing unit 504 monitors the temperature of the fixing roller and controls so as to keep a suitable fixing temperature. When the sheets draw heat largely, the temperature of the fixing roller decreases. In this case, the fixing unit 504 notifies a print control unit of the fall of temperature of the fixing roller. When receiving this notification, the print control unit widens sheet conveyance intervals in order to control so that the temperature of the fixing roller does not drop below the specified temperature. When the temperature of the fixing roller still does not return, the print control unit once interrupts operations, and restarts the operation after the temperature of the fixing roller returns to the suitable temperature.

When all the sheets have been ejected, the print control unit instructs the respective units to stop the operation, and notifies the main control unit of the end of operation when being notified of the operation stops from the respective units. It should be noted that three or more sheet storage sheds may be connected and used depending on an apparatus configuration, although the illustrated example employs two sheet storage sheds.

Figure 3:
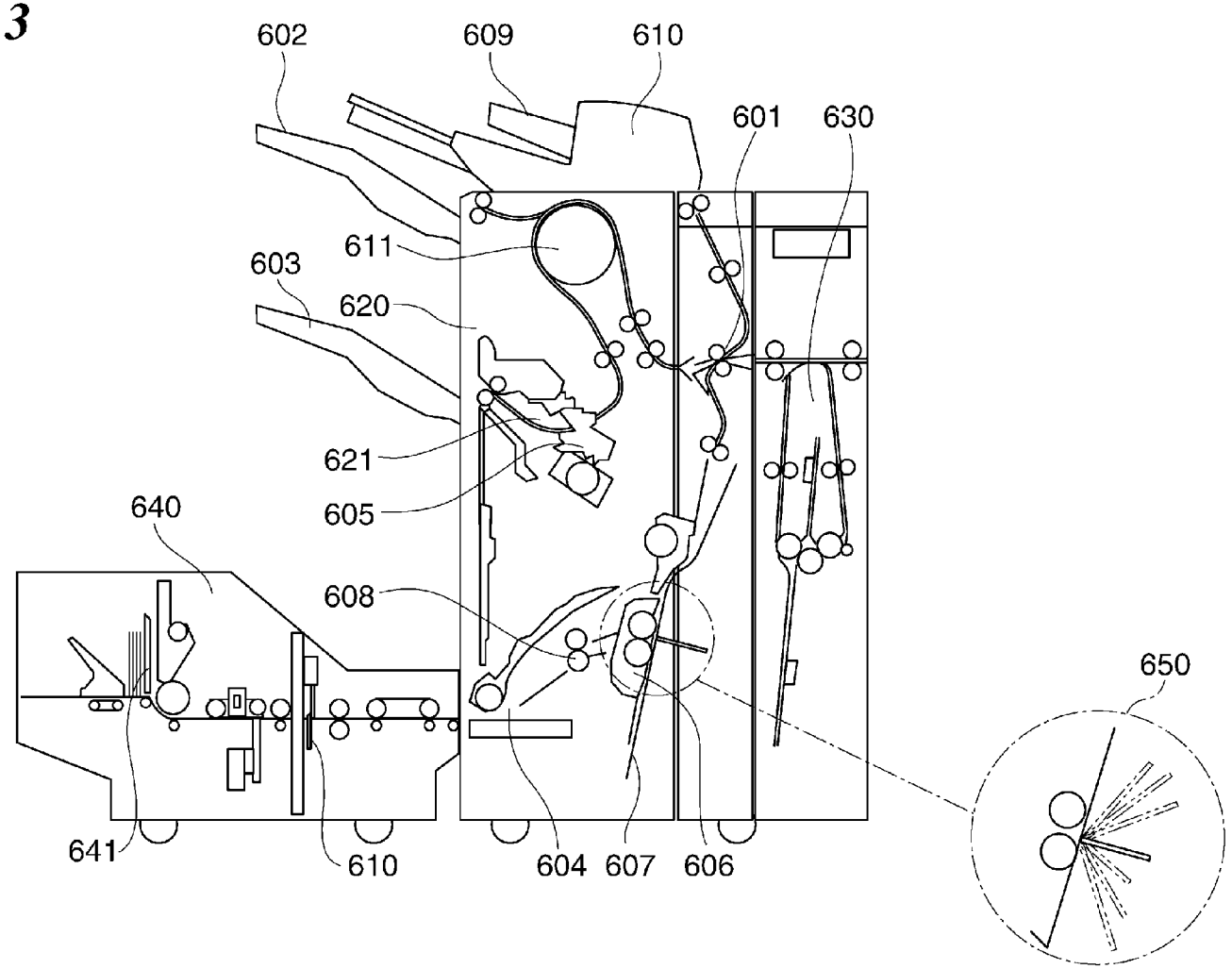
FIG. 3 is a sectional view schematically showing an internal configuration of a post-processing device that constitutes the printing system shown in FIG. 1.

FIG. 3 is a sectional view schematically showing an internal configuration of the post-processing device that constitutes the printing system shown in FIG. 1.

As shown in FIG. 3, the post-processing device (in-line finisher) that has a bookbinding process function is connected to the downstream side of the image forming apparatus shown in FIG. 2. The sheet ejected from the fixing unit 504 in the image forming apparatus is conveyed to the post-processing device.

As shown in FIG. 3, the post-processing device has a sample tray 602 and a stack tray 603, and switches a tray of an ejection destination according to a type of a print job or the number of sheets ejected. It should be noted that there are a bin sorting method that distributes sheets to a plurality of bins and a shift sorting method that distributes output sheets for every print job by shifting bins (or trays) in a front-back direction using an electronic sorting function. The electronic sorting function is called a collation. When the main control unit has a bulk memory, the electronic sorting function is supported by the collation function that changes an ejection order from an order of buffered pages using the memory as a buffer. On the other hand, a grouping function is used to classify sheets for every page.

When a staple mode is set to a print job that should be outputted, sheets are accumulated on a processing tray 621 before ejecting to the stack tray 603 for every print job. On the processing tray 621, the sheets are bound by a stapler 605. And then, a bundle of the sheets is ejected to the stack tray 603. In addition, there are a Z-folding machine 630 that folds up a sheet in a Z-shape and a puncher 611 that punches two (or three) holes in a sheet for filing on a path leading to the two above-mentioned trays, and they perform the respective processes according to the type of a print job. For example, when the Z-folding process is set to the print job, the Z-folding machine 630 folds sheets in the Z-shape. The folded sheets are ejected to the sheet ejection tray, such as the stack tray 603 or the sample tray 602. Moreover, when the punching process is set to the print job, the puncher 611 punches holes in the sheets. The punched sheets are ejected to the sheet ejection tray.

An inserter 631 sends a sheet set on an insertion tray 609 to the sheet ejection tray without passing through the image forming apparatus. Thereby, the sheet set on the inserter 631 can be inserted between a plurality of sheets sent into the post-processing device. Sheets are set on the insertion tray 609 in a faceup manner, and are sequentially fed by a pickup roller from the topmost sheet. The sheet from the inserter 631 is ejected in a facedown manner by conveying to the stack tray 603 or the sample tray 602 as-is. Moreover, when a sheet is sent to a saddle stitcher 606, the sheet is once sent to the side of the puncher 611, and then, is sent to the saddle stitcher by switching back so as to match the face sides. It should be noted that it is determined whether the insertion process is executed by the inserter 631 based on the sheet process setting set to the print job by the operator.

The saddle stitcher 606 binds two portions in the center of a sheet, and then, performs a process for making a booklet (bookbinding process) by folding the sheets in half while grasping the center of the sheets with rollers. The sheets that were bound by the saddle stitcher 606 are ejected to a booklet tray 604. It is determined whether the sheet processes, such as the bookbinding process by the saddle stitcher 606, are performed based on the sheet process setting set to the print job by the operator.

A trimmer (cutting machine) 640 conveys the booklet formed by the saddle stitcher 606 by a predetermined distance with rollers, and cuts a fore edge of the booklet with a cutter 610. The fore edge of a booklet is uniformly cut, and the booklet is stored in a booklet holding unit 641. It should be noted that it is determined whether the cutting process is executed by the trimmer 640 based on the sheet process setting set to the print job by the operator.

Next, the bookbinding process in the post-processing device will be described.

The sheet on which an image was formed is conveyed from the image forming apparatus, and reaches a path switching flapper 601. Then, the path switching flapper 601 selects a sheet conveyance destination path from among the conveyance path to the sample tray 602, the conveyance path to the stack tray 603, and the conveyance path to the booklet tray 604. When a sheet is ejected to the sample tray 602, the sheet is ejected as-is, because the post-processing device cannot process. When a sheet is ejected to the stack tray 603, the sheet goes through the processing tray 621. When a sheet is ejected to the processing tray 621, the stapler 605 performs a staple process, or shifts the sheet in the front-back direction of the device according to the setting.

The saddle stitcher 606 binds at the positions on a folding line, by which sheets will be folded in half later, of one set of the sheet bundle. In the case of a saddle folding, this saddle stitching is omitted and the sheet bundle is conveyed to a stopper 607. The sheet bundle loaded on the stopper 607 is conveyed by a bundle conveyance roller pair 608, is folded in half, and is ejected to the booklet tray 604.

The state of three sheets folded in half by the saddle stitcher 606 is shown in an enlarged circle 650. Since the center of the sheet bundle is stapled, the sheet bundle is stably conveyed as one bundle even when being conveyed by the bundle conveyance roller pair 608 and being cut with the cutter 610. On the other hand, since sheets are not united when the saddle stitching is not performed, the larger the number of sheets or basis weight of a sheet is, the more difficult to keep accuracy of cutting becomes.

Figure 4:
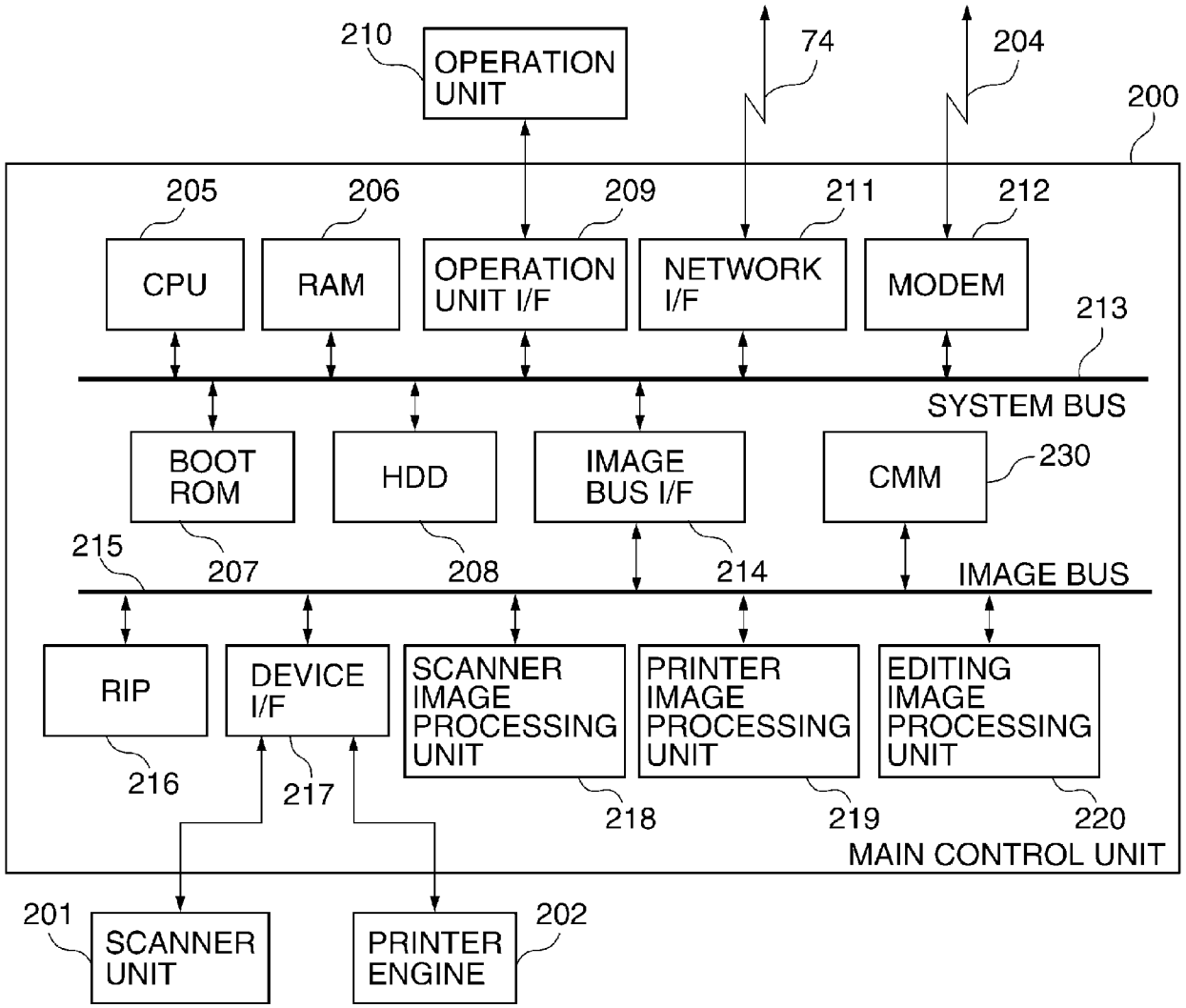
FIG. 4 is a block diagram schematically showing a hardware configuration example of a main control unit of the image forming apparatus shown in FIG. 2.

FIG. 4 is a block diagram schematically showing a hardware configuration example of the main control unit of the image forming apparatus.

As shown in FIG. 4, the main control unit 200 controls a reading of image data by a scanner unit 201 that is an image input device, and a print output of image data by a printer engine 202 that is an image output device. Moreover, the main control unit 200 controls input and output of image information or device information through a network 74 or a public line 204.

A CPU 205 is a central processing unit for controlling the whole image forming apparatus. A RAM 206 is a system work memory for an operation of the CPU 205, and is also an image memory for storing inputted image data temporarily. A boot ROM 207 stores a boot program for the system. A hard disk drive (HDD) 208 stores system software for performing various process, inputted image data, etc.

An operation unit I/F 209 is connected to an operation unit 210 having a display screen that can display image data etc., and outputs operation-screen data to the operation unit 210. Moreover, the operation unit I/F 209 transfers information inputted by the operator through the operation unit 210 to the CPU 205.

The network I/F 211 connects with the network 74 through a NIC (not shown), for example, and exchanges information with the external apparatuses, such as the print server 71 and the host computer 72. Although the above description shows the configuration to connect with one network through one network I/F, a configuration to connect with a plurality of networks using a plurality of network I/Fs is also included in this embodiment. A modem 212 connects with the public line 204 and exchanges information with external apparatuses.

The above units are arranged on a system bus 213.

An image bus I/F 214 is an interface that connects the system bus 213 with an image bus 215 that transmits image data at high speed, and is a bus bridge that converts a data structure. A raster image processor (RIP) 216, a device I/F 217, a scanner image processing unit 218, a printer image processing unit 219, an editing image processing unit 220, and a color management module (CMM) 230 are connected to the image bus 215.

The RIP 216 expands a page description language (PDL) code or below-mentioned vector data to an image. The device I/F 217 connects to the scanner unit 201 and the printer engine 202, and converts the image data between a synchronizing system and an asynchronous system.

The scanner image processing unit 218 can correct, process, and edit image data that is inputted from the scanner unit 201. According to the ability of the printer engine 202, the printer image processing unit 219 can correct the image data to be outputted by printing, and can convert resolution. The editing image processing unit 220 performs various image processes, such as a rotation, compression, and expansion of image data.

The CMM 230 is a dedicated hardware module that applies a color conversion process (it is also called "a color space conversion process") to image data based on a profile or calibration data. A profile is information like a function for converting color image data expressed in an apparatus-dependent color space into color image data expressed in an apparatus-independent color space (for example, Lab). Calibration data is used for correcting color reproduction characteristic of the scanner unit 201 or the printer engine 202.

Figure 5:
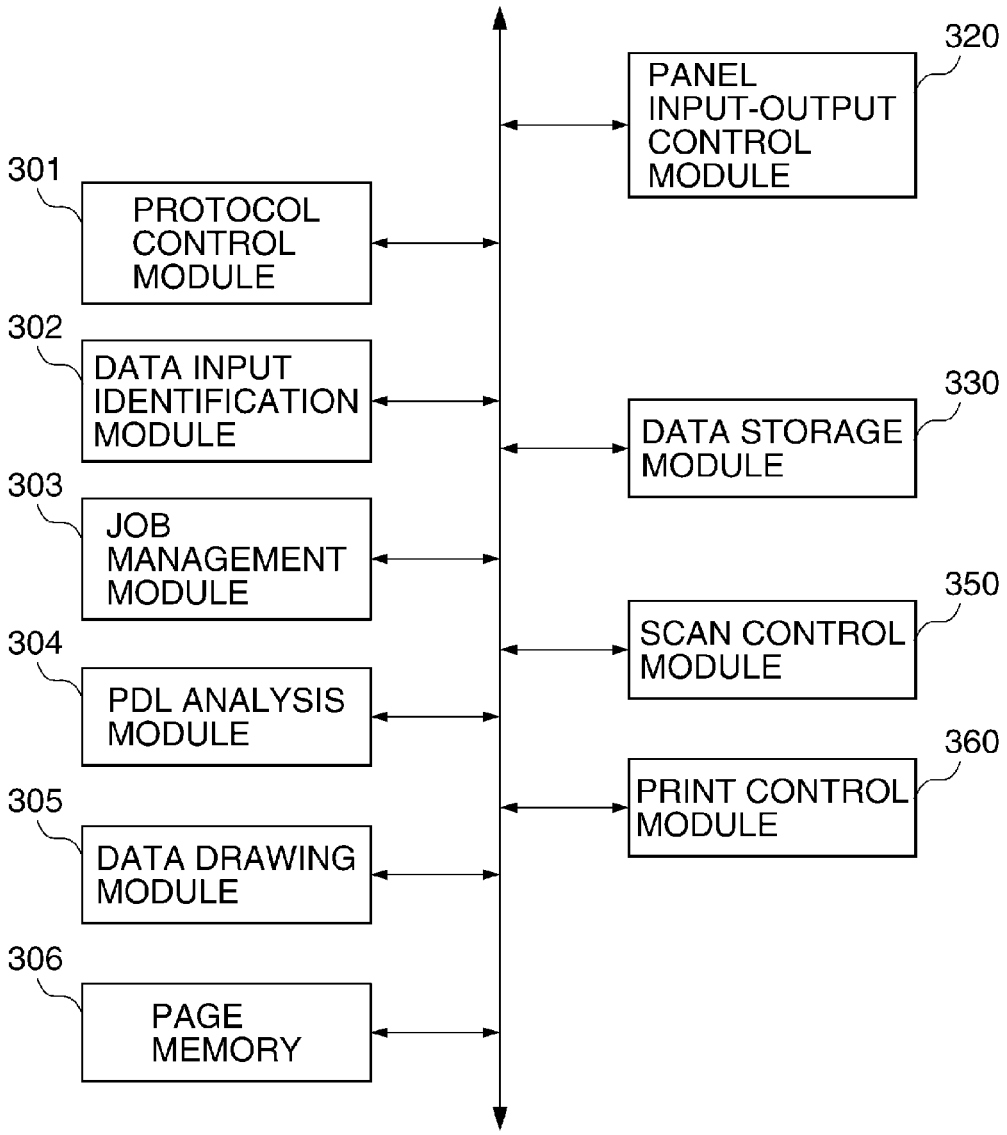
FIG. 5 is a block diagram schematically showing a functional configuration of the main control unit shown in FIG. 4.

FIG. 5 is a block diagram schematically showing a functional configuration of the main control unit 200 shown in FIG. 4.

A protocol control module 301 communicates with the exterior by analyzing and transmitting a network protocol. It should be noted that a plurality of protocol control modules 301 may be provided according to a plurality of network I/Fs, or the control module 301 may processes inputs from a plurality of network I/Fs.

A data input identification module 302 identifies a print job inputted through the network I/F 211. A job management module 303 manages the inputted print job, performs a division process for a print job, and processes the information about device control according to the print setting added to a print job.

A PDL analysis module 304 analyzes PDL data, and converts it into an intermediate code (DisplayList: DL) that is a form easier to process. The DL converted by the PDL analysis module 304 is passed to a data drawing module 305.

The data drawing module 305 expands the DL to bitmap data. The expanded bitmap data is successively drawn on a page memory 306. The page memory 306 is a volatile memory that holds the expanded bitmap data temporarily. A panel input-output control module 320 controls input and output from the operation unit 210.

A data storage module 330 stores various data files, such as an inputted print job and a scan job inputted from the scanner unit 201, inputted into the image forming apparatus to the HDD 208 etc.

A scan control module 350 corrects, processes, and edits image data that is inputted from the scanner unit 201. A print control module 360 converts the contents of the page memory 306 into a video signal, and transmits an image to the printer engine 202. The printer engine 202 is a print station that forms a visible image on a recording sheet according to the received video signal.

Figure 6:
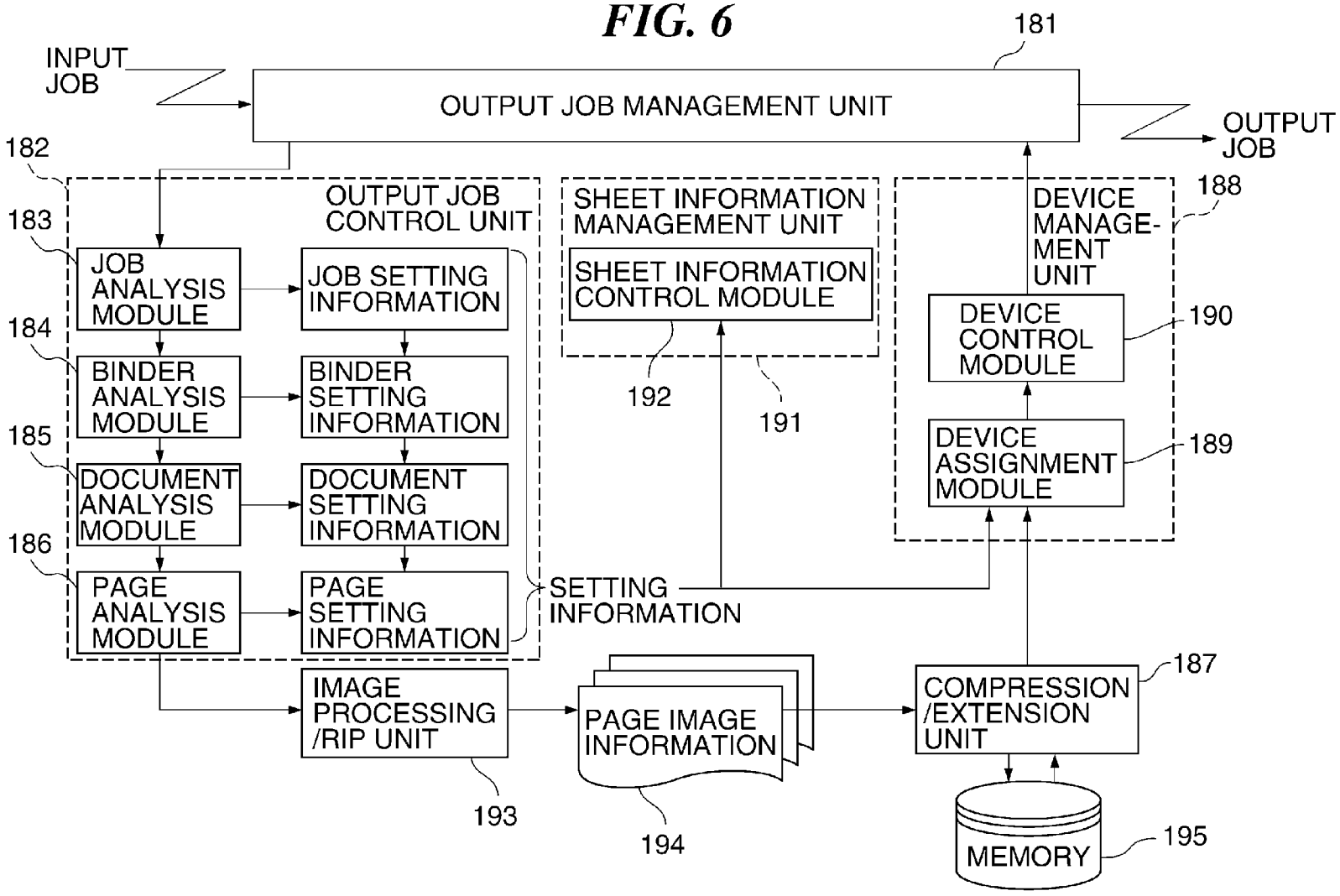
FIG. 6 is a block diagram showing a configuration example of an output job management unit in the image forming apparatus shown in FIG. 2.

FIG. 6 is a block diagram showing a configuration example of an output job management unit in the image forming apparatus.

An output job management unit 181 (the job control module 303) manages a print job inputted through the network I/F 211, and controls reading and writing of print jobs to a memory 195 (the page memory 306) and the processing order thereof.

An output job control unit 182 consists of a job analysis module 183, a binder analysis module 184, a document analysis module 185, and a page analysis module 186, and generates setting information (job ticket) about a print job and image information.

The job analysis module 183 generates print job setting information by analyzing details of the setting information concerning the whole print job, such as a document name to be printed, the number of copies, a specification of an ejection tray as an output destination, the order of binders in print job that consists of a plurality of binders. The binder analysis module 184 generates binder information by analyzing details of the setting information concerning the whole binder, such as a setting of a bookbinding method, the order of documents of a binder that consists of a plurality of documents.

The document analysis module 185 generates document setting information by analyzing details of the setting information concerning the whole document, such as the page order of a document, a specification of double-side printing, addition of a cover or a mount. The page analysis module 186 generates page-setting information by analyzing details of setting information concerning the whole page, such as an image resolution, an image orientation (landscape/portrait).

A sheet information management unit 191 manages the information about the sheet type in the printing process analyzed by the output job control unit 182. A sheet information control module 192 generates a sheet information management table showing attribute information about the sheet type in the printing process. Moreover, the sheet information control module 192 describes alias information, which was selected or inputted by the operator, in the sheet information management table.

It should be noted that the processes by the output job management unit 181 and the sheet information management unit 191 may be executed on the host computer 72, although the processes shall be executed on the printing system 75 in this embodiment. Moreover, the above-mentioned processes may be executed on the print server 71.

When image information is generated based on a scan image, an image process for scan image is applied. In the case of PDL data, an image processing/RIP unit 193 is called to generate page image information 194 by rendering. The page image information 194 is compressed by a compression/extension unit 187. Then, the page image information 194 is associated with a scenario and setting information, and is stored in the memory 195.

A device management unit 188 consists of a device assignment module 189 and a device control module 190. The page image information 194, which is read from the memory 195 together with the scenario and the setting information associated, is extended by the compression/extension unit 187. The scenario, the setting information, and the page image information 194 are inputted into the device management unit 188 as one set.

When assigning a device based on the scenario, the device assignment module 189 arbitrates collision between devices that will occur when a plurality of print jobs proceed processes simultaneously. The device control module 190 schedules a device used and timing.

Figure 7:
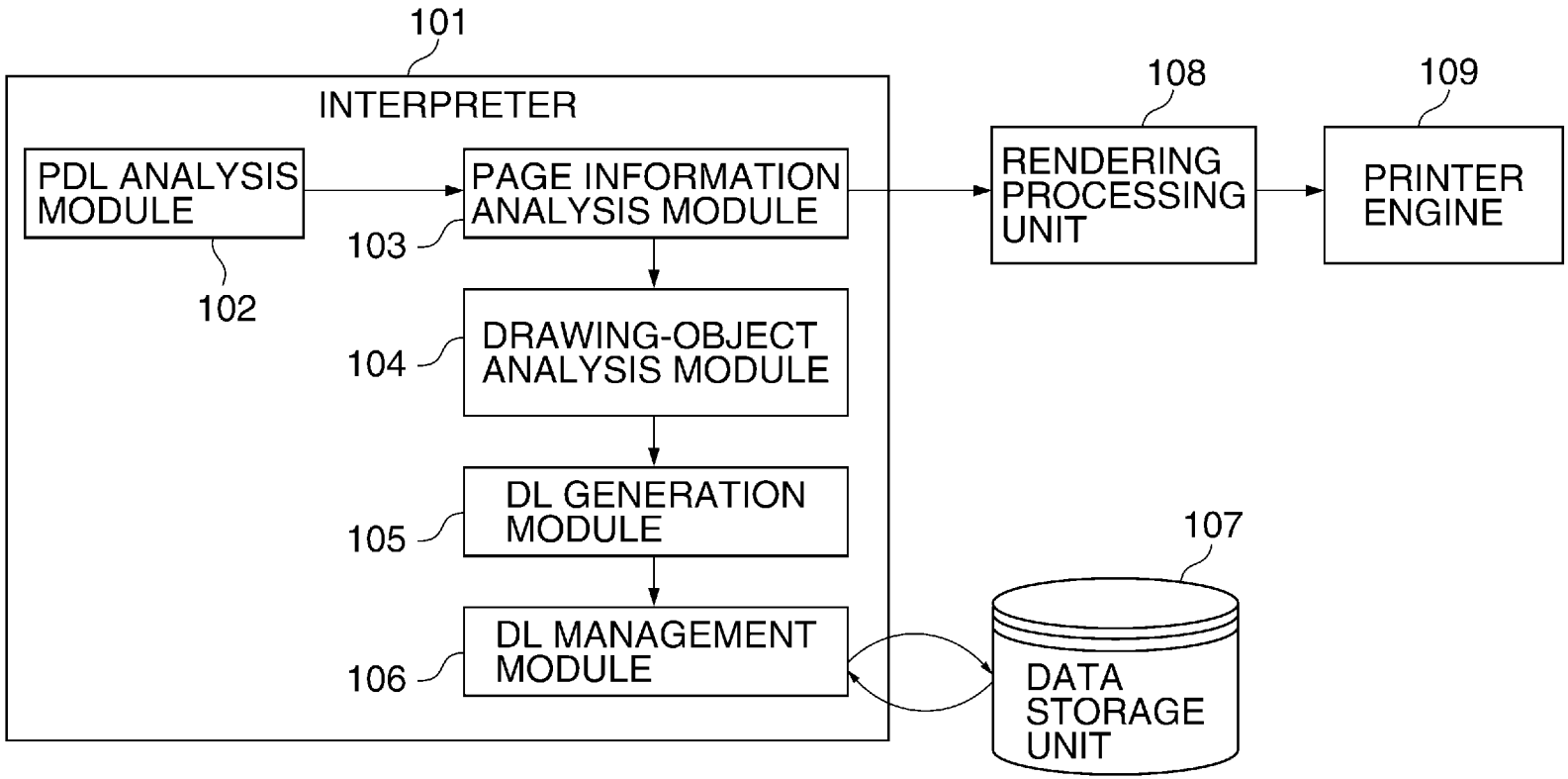
FIG. 7 is a block diagram showing a configuration example of a drawing processing unit in the image forming apparatus shown in FIG. 2.

FIG. 7 is a block diagram showing a configuration example of a drawing processing unit in the image forming apparatus. The drawing processing unit consists of two sections, an interpreter 101 and a rendering processing unit 108.

It should be noted that a rendering process rasterizes each object information as a raster image on a memory (not shown), in order to reproduce vector information (a character, a line drawing, a diagram, etc., which are described in the PDL) and bit map information as a page simultaneously.

The interpreter 101 is provided with a PDL analysis module 102 (the PDL analysis unit 304) that analyzes language of PDL data. Moreover, the interpreter 101 has a page information analysis module 103 that analyzes page information included in PDL data, and a drawing-object analysis module 104 that analyzes a drawing object included in the PDL data. Furthermore, the interpreter 101 has a DL generation module 105 that generates DL based on a drawing object. Furthermore, the interpreter 101 has a DL management module 106 that can read/write DL data in a data storage unit 107 (the data storage module 330) when a drawing object and a font can be reused by caching.

The PDL analysis module 102 can analyze various kinds of PDL data inputted. In addition, data in the format for VDP, such as PPML, PDF/VT, etc. can also be processed. Furthermore, the image-compression format like JPEG (Joint Photographic Experts Group), TIFF (Tagged Image File Format), etc. can also be processed.

The rendering processing unit 108 consists of a CMM (not shown) that performs color matching to a DL, and a DL rendering unit (not shown) that renders a DL as bitmap data (a raster image).

The printer engine 109 (the printer engine 202) reads the bitmap data generated by the rendering processing unit 108, and performs the printing process.

Next, an external appearance configuration of the operation unit 210 of the image forming apparatus will be described with reference to FIG. 8A and FIG. 8B.

Figure 8A:
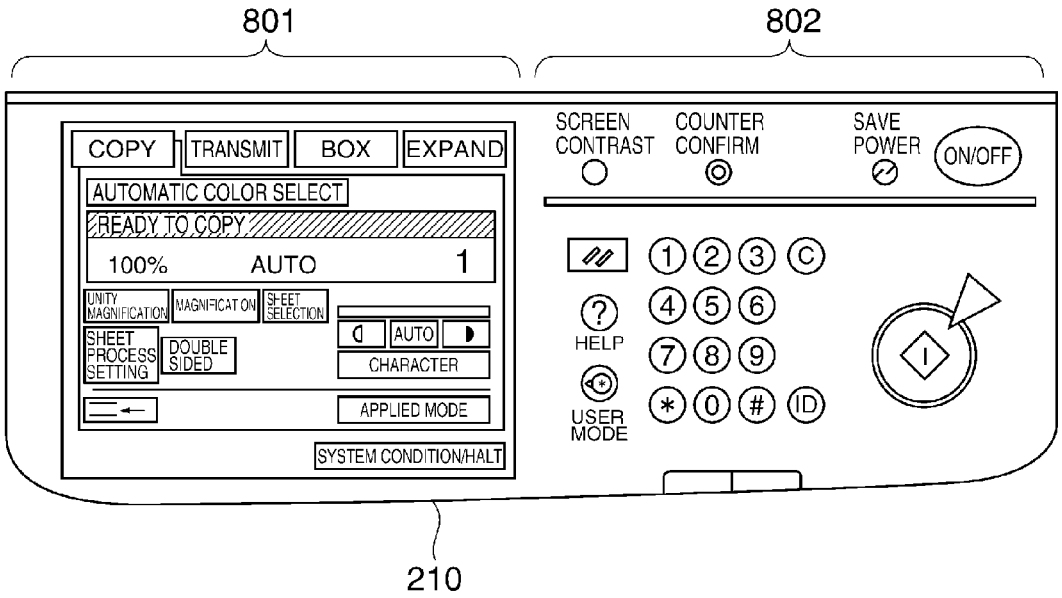
FIG. 8A is a view showing an example of an external appearance configuration of an operation unit of the image forming apparatus shown in FIG. 2.

FIG. 8A is a view showing an example of an external appearance configuration of the operation unit 210 of the image forming apparatus. FIG. 8B is a view showing an example of an external appearance configuration of a key input unit 802 shown in FIG. 8A.

As shown in FIG. 8A, the operation unit 210 has the key input unit 802 that can receive an operator's operation with hardkeys, and a touch panel section 801 as a display unit that can receive an operator's operation with softkeys (displayed keys).

Figure 8B:
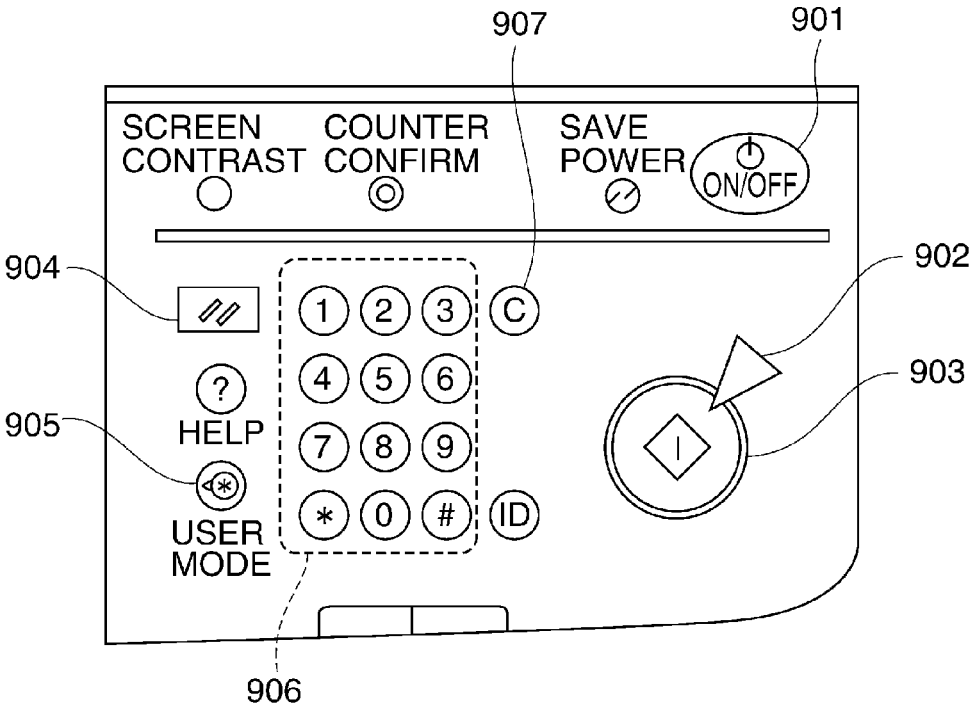
FIG. 8B is a view showing an example of an external appearance configuration of a key input unit shown in FIG. 8A.

As shown in FIG. 8B, a power switch 901 is arranged in the key input unit 802. When the power switch 901A is operated, the CPU 205 switches a standby mode and a sleep mode selectively. The standby mode is a normal operation state. The sleep mode is a state where the program is stopped while waiting an interrupt by network print, facsimile, etc., to reduce power consumption.

When a main power supply switch (not shown) that turns on and off the power of the entire system is in an ON state, the CPU 205 controls to allow receiving an operator's operation to the power switch 901.

A start key 903 is used to allow receiving an operator's instruction that makes the printing device start the job process of the type instructed by the operator, such as a copy operation and a send action of a job used as a processing target. A stop key 902 is used to allow receiving an operator's instruction that makes the printing device stop the job process received. A ten-key pad 906 is used to allow setting registrations of various settings by the operator. A clear key 907 is used to cancel various parameters, such as the registrations set up by the operator through the ten-key pad 906. A reset key 904 is used to invalidate the various settings set up to the processing target job by the operator, and to receive an instruction that initializes the setting values to a default condition. An operator mode key 905 is used to make a transition to a system setting screen designed for each operator.

Next, a printed matter (a bookbound matter) generated when the cutting process is applied to a sheet bundle that is folded in half without a saddle stitching will be described with reference to FIG. 9A and FIG. 9B.

Figure 9A:
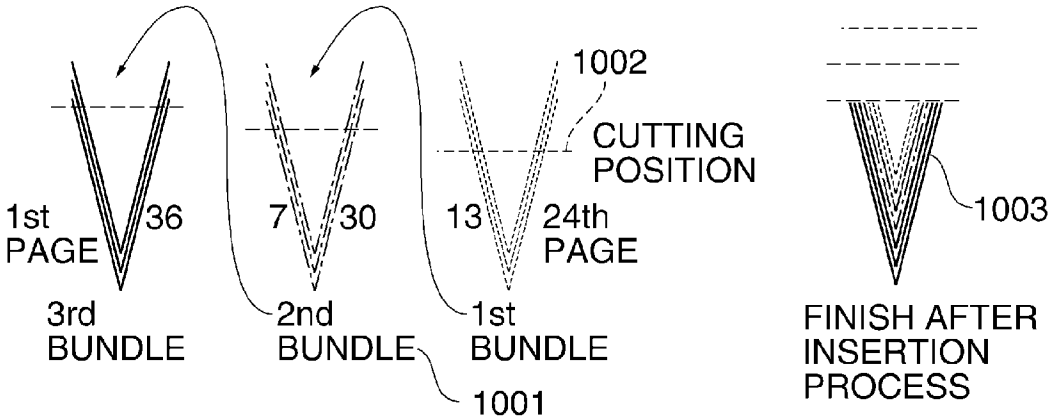
FIG. 9A is a view showing examples of a cutting process for sheet bundles and an insertion process to form a printed matter (division bookbinding) executed by the printing system shown in FIG. 1.

FIG. 9A is a view showing examples of a cutting process for sheet bundles and an insertion process to form a printed matter (division bookbinding). FIG. 9B is a view showing examples of a cutting process for sheet bundles and a stacking process to form a printed matter (separation bookbinding).

In FIG. 9A, the print matter 1003 is constructed by the insertion process using three sheet bundles 1001.

A division process is applied to sheets of an inputted job according to the upper limit of sheet number that can be processed by the post-processing device or the sheet number specified by the operator. Each of the sheet bundles 1001 is formed by applying an imposition process and a printing process to the divided sheets, and by gathering the processed sheets and folding them in half. It should be noted that each sheet bundle consists of three sheets in this embodiment.

Furthermore, the printed matter 1003 is completed because an operator inserts an inside sheet bundle in an outside sheet bundle (i.e., covers an inside sheet bundle with an outside sheet bundle) after applying the cutting process to the sheet bundles according to different cutting amounts (dotted lines show cutting positions 1002 in the illustrated example) computed by a cutting amount adjustment process mentioned later. The cutting positions of the respective sheet bundles are determined so that the fore edge (cutting side) of the printed matter 1003 becomes uniform.

Figure 9B:
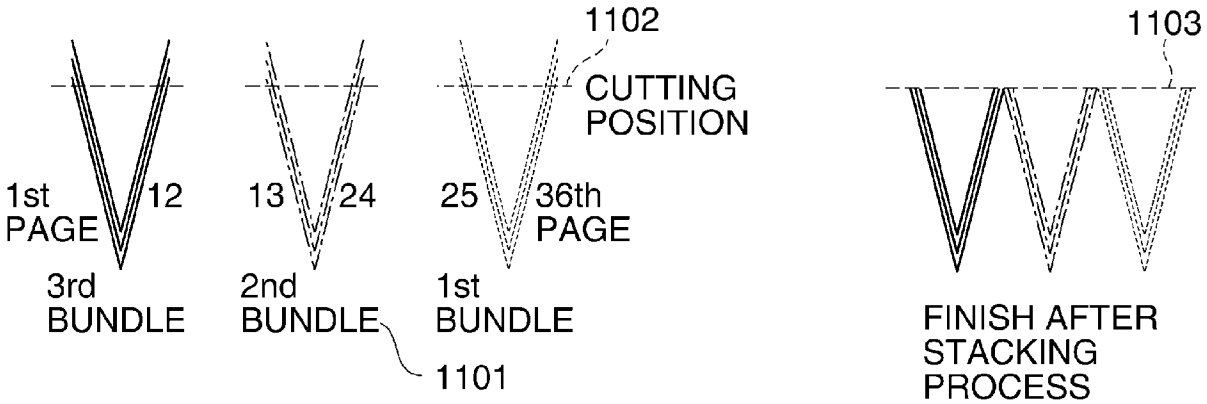
FIG. 9B is a view showing examples of a cutting process for sheet bundles and a stacking process to form a printed matter (separation bookbinding) executed by the printing system shown in FIG. 1.

In FIG. 9B, the printed matter 1103 is constructed by stacking and stitching three sheet bundles 1001.

Each of the sheet bundles 1001 is formed by applying an imposition process and a printing process to sheets that are separated according to a separation process specification to an inputted job, and by gathering the processed sheets and folding them in half. It should be noted that each sheet bundle consists of three sheets in this embodiment.

Furthermore, when the cutting process is specified, all the sheet bundles are cut according to specified common cutting amount (dotted lines show cutting positions 1102 in the illustrated example), and then, are ejected. The printed matter 1103 is completed because the operator stacks (adjoins) and stitches the ejected bundles. Since each bundle is cut at the same position, the fore edge (cutting side) of the printed matter 1103 becomes uniform.

Next, a printing-bookbinding process to a print job in the case where the cutting process is performed without performing a saddle stitching process when bookbinding and printing are specified will be described.

Figure 10:
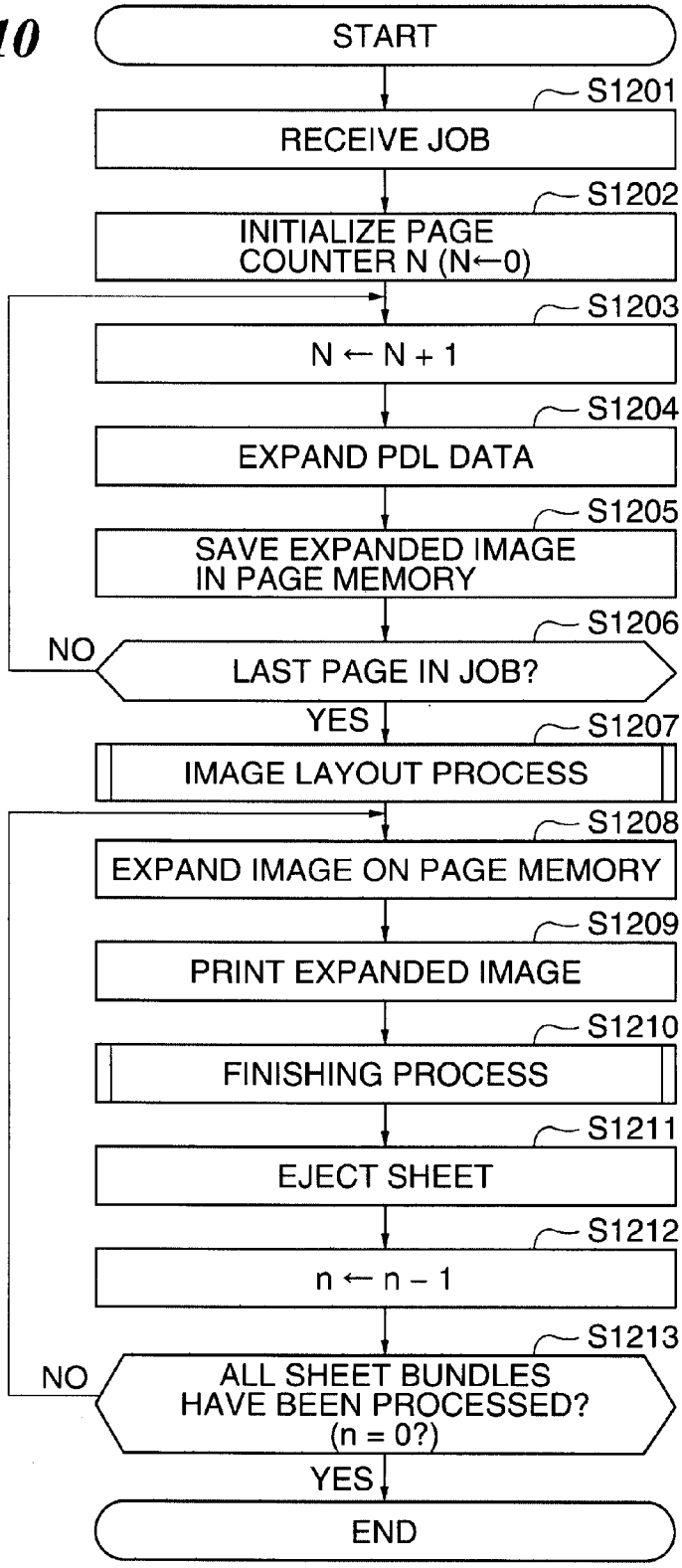
FIG. 10 is a flowchart showing a fundamental procedure of a printing-bookbinding process executed by the printing system according to the first embodiment of the present invention.

FIG. 10 is a flowchart showing a fundamental procedure of the printing-bookbinding process executed by the printing system 75.

The printing system 75 receives a job from the host computer 72 or the like through the network I/F 211 (step S1201).

First, the PDL analysis unit 304 initializes a page counter N that is used for managing a job processing status at a processing start (step S1202). Next, the PDL analysis unit 304 increment the page counter N by one in order to process per page (step S1203).

Next, the PDL analysis unit 304 analyzes the PDL data included in the job, and the data drawing unit 305 expands the analyzed data to bitmap data (step S1204). Then, the expanded bitmap data is saved in the page memory 306 (step S1205).

Next, the PDL analysis unit 304 determines whether the page of which processing was completed is the last page in the job (step S1206). When it is determined as the last page, the process proceeds to step S1207. On the other hand, when it is not determined as the last page, the process in the steps S1203 through S1206 is repeated until all the pages in the job have been processed.

An image layout process is executed in the step S1207. Specifically, a user changes the order of pages, specifies a page composition process, and makes a fine adjustment to printing position according to the print setting etc. that were specified on operation screens shown in FIG. 17A through FIG. 17F, and FIG. 18A through FIG. 18C. Details of the image layout process will be described below.

FIG. 17A through FIG. 17F show the operation screens 2001, 2002, 2003, 2004, 2005, and 2006 displayed with the control program of the printing system in this embodiment.

Figure 18A:
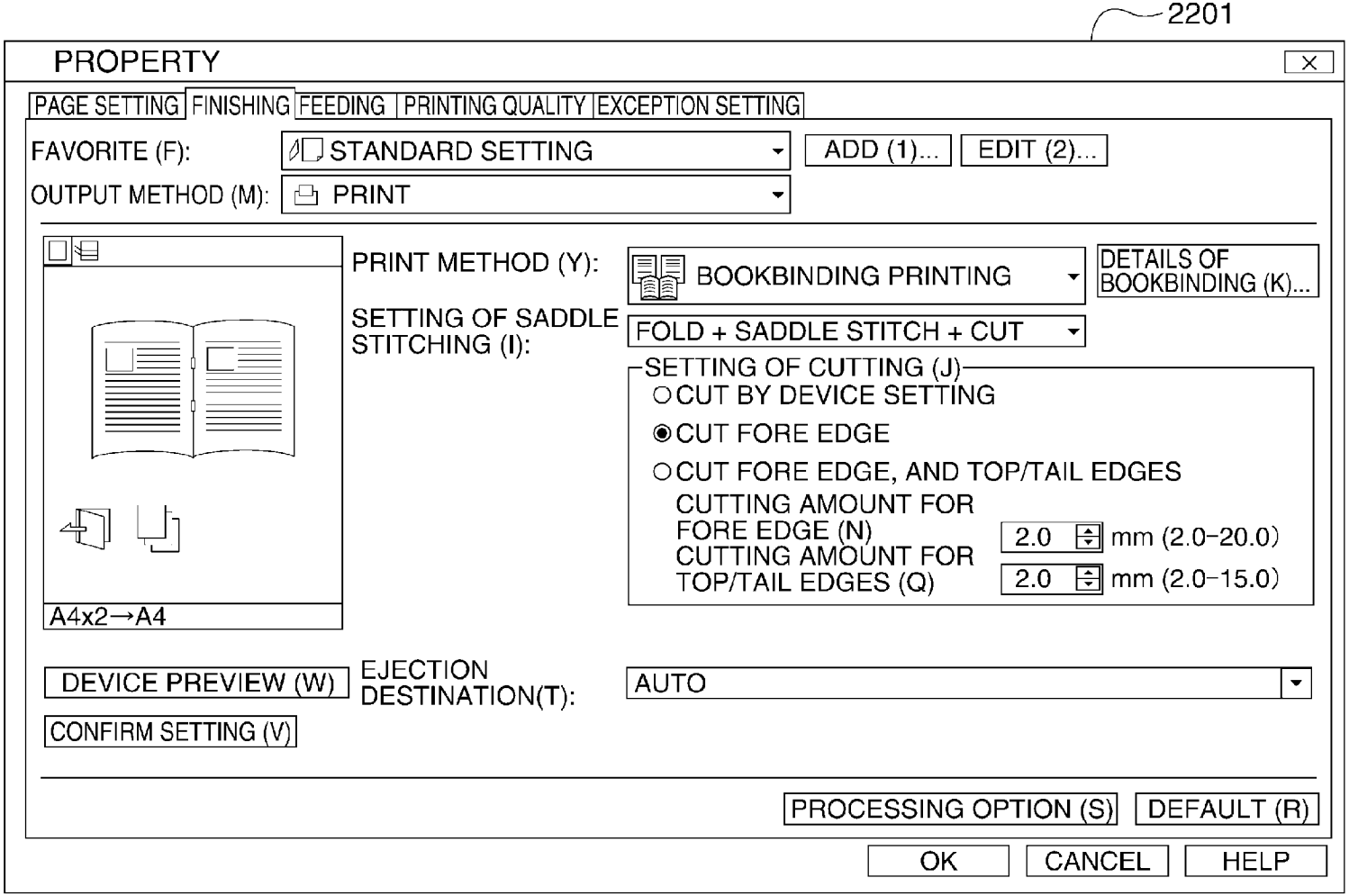
Figure 18B:
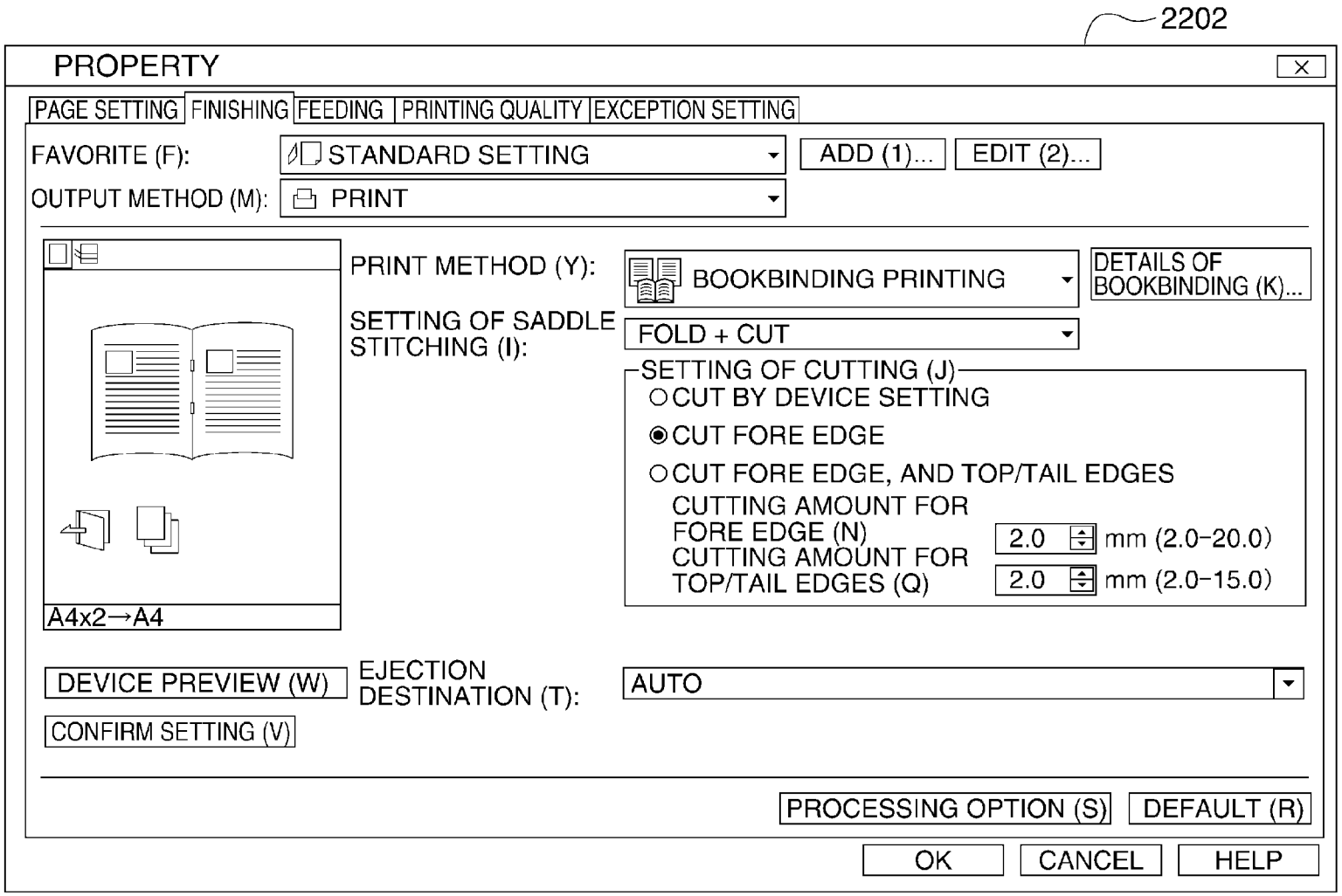

FIG. 18A through FIG. 18C show the operation screens 2201, 2202, and 2203 displayed on the host computer 72 or 73 for generating a print job.

The description returns to FIG. 10. After completing the image layout process in the step S1207, the processed image is expanded on the page memory 306 (step S1208). Then, the image expanded in the step S1208 is sent out to the printer engine 202, and the printing process is executed (step S1209). After completing the printing process, the process proceeds to step S1210.

A finishing process is executed in the step S1210. Specifically, the post processes, such as the folding process and the cutting process, are executed to the sheet printed in the step S1209 according to a bookbinding setting etc. that were specified by a user on the operation screens shown in FIG. 17A through FIG. 17F, and FIG. 18A through FIG. 18C. Details of the finishing process will be described below.

Next, the sheet bundle to which the post-process was performed in the step S1210 is ejected in step S1211. Subsequently, the print control module 360 computes the remaining number of sheet bundles that need the process by decrementing the sheet bundle number n in step S1212. Then, the print control module 360 determines whether all the sheet bundles have been processed (step S1213). When it is determined that all the sheet bundles have been processed, this process finishes. On the other hand, when it is determined that not all the sheet bundles have been processed, the process in the steps S2308 through S1213 is repeated until the process is completed.

Figure 11:
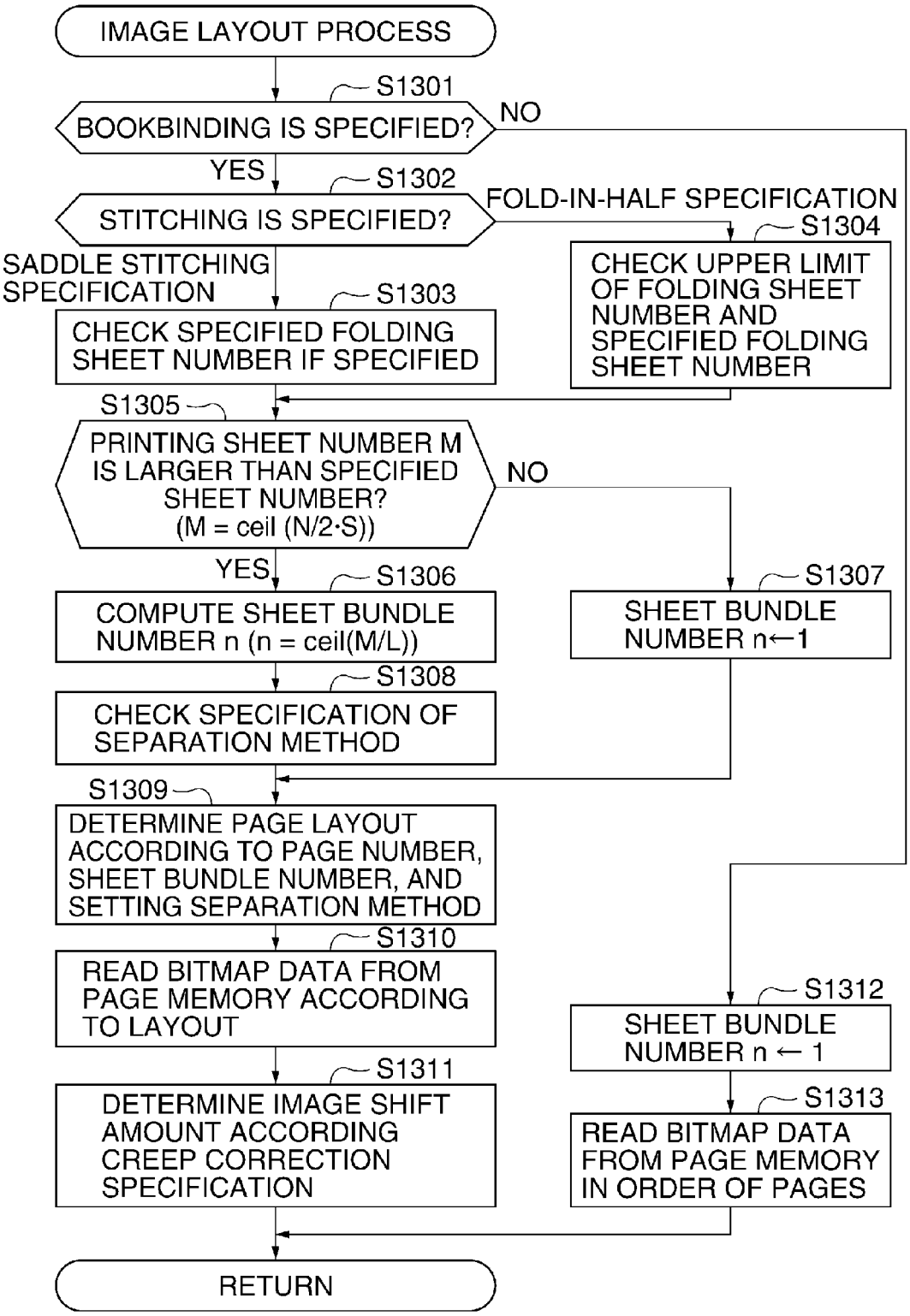
FIG. 11 is a flowchart showing details of an image layout process in the step S1207 in FIG. 10.

FIG. 11 is a flowchart showing details of an image layout process in the step S1207 in FIG. 10.

The print control module 360 determines whether there is a bookbinding specification (step S1301). When determining that there is no bookbinding specification, the print control module 360 sets the sheet bundle number n to 1 (step S1312). Subsequently, the print control module 360 reads the bitmap data from the page memory 306 in the order of pages included in the job (step S1313), and returns the process.

On the other hand, when determining that there is a bookbinding specification in the step S1301, the print control module 360 determines whether there is a stitching specification (step S1302). When determining that there is a stitching specification, the print control module 360 determines whether an operator specified the folding sheet number, and checks the specified folding sheet number if specified (step S1303), and proceeds with the process to step S1305.

On the other hand, when it is determined that there is no stitching specification in the step S1302, it is determined as a fold-in-half specification, and the process proceeds to step S1304.

In the step S1304, the print control module 360 checks the upper limit of the folding sheet number of the post-processing device and the specified folding sheet number specified by the operator, and proceeds with the process to step S1305.

In the step S1305, the print control module 360 computes the printing sheet number M needed to perform the printing process for the job based on the page number and the bookbinding specification that are included in the job. Then, the printing sheet number M is compared with the specified folding sheet number checked in the step S1303 or the step S1304.

An example of an operation expression for finding the printing sheet number M is shown as follows.

$$M=\mathrm{ceil}(N/2\cdot S)$$

N: Number of pages included in a job

S: Constant for specifying single-side printing or double-side printing

For single-side-printing: S=2

For double-side printing: S=4 ceil( ): Function to make integer by rounding up decimals

When the determination result in the step S1305 shows that the printing sheet number M is below the specified folding sheet number, the process proceeds to step S1307, and the print control module 360 sets the sheet bundle number n of the job to "1".

On the other hand, when it is determined that the printing sheet number M is more than the specified folding sheet number in the step S1305, the process proceeds to step S1306, and the print control module 360 computes the sheet bundle number n of the job. Specifically, the sheet bundle number n is computed based on the page number N included in the job, the specification of single-side printing or double-side printing, and the specified folding sheet number checked in the step S1303 or S1304. The process in the step S1306 is an example of a sheet-bundle-number computation unit.

An example of an operation expression for finding the number n of sheet bundles that are made until the job process is completed is shown as follows.

$$n=\mathrm{ceil}(M/L)$$

L: Specified folding sheet number

In the next step S1308, the print control module 360 checks a specification of the separation method.

In step S1309, the print control module 360 determines a page layout according to the number of pages included in the job, the number n of the sheet bundles into which the job is divided, and the setting separation method based on the determination result in the step S1308. The step S1309 is an example of a page-layout determination unit.

Next, the print control module 360 reads bitmap data (an expanded image) from the page memory 306 in order based on the layout determined in the step S1309 (step S1310). Subsequently, when there is a creep correction specification, the print control module 360 determines image shift amount of the bitmap data according to the creep correction specification concerned (step S1311), and returns the process. This creep correction specification will be mentioned below with a creep correction function.

Figure 12:
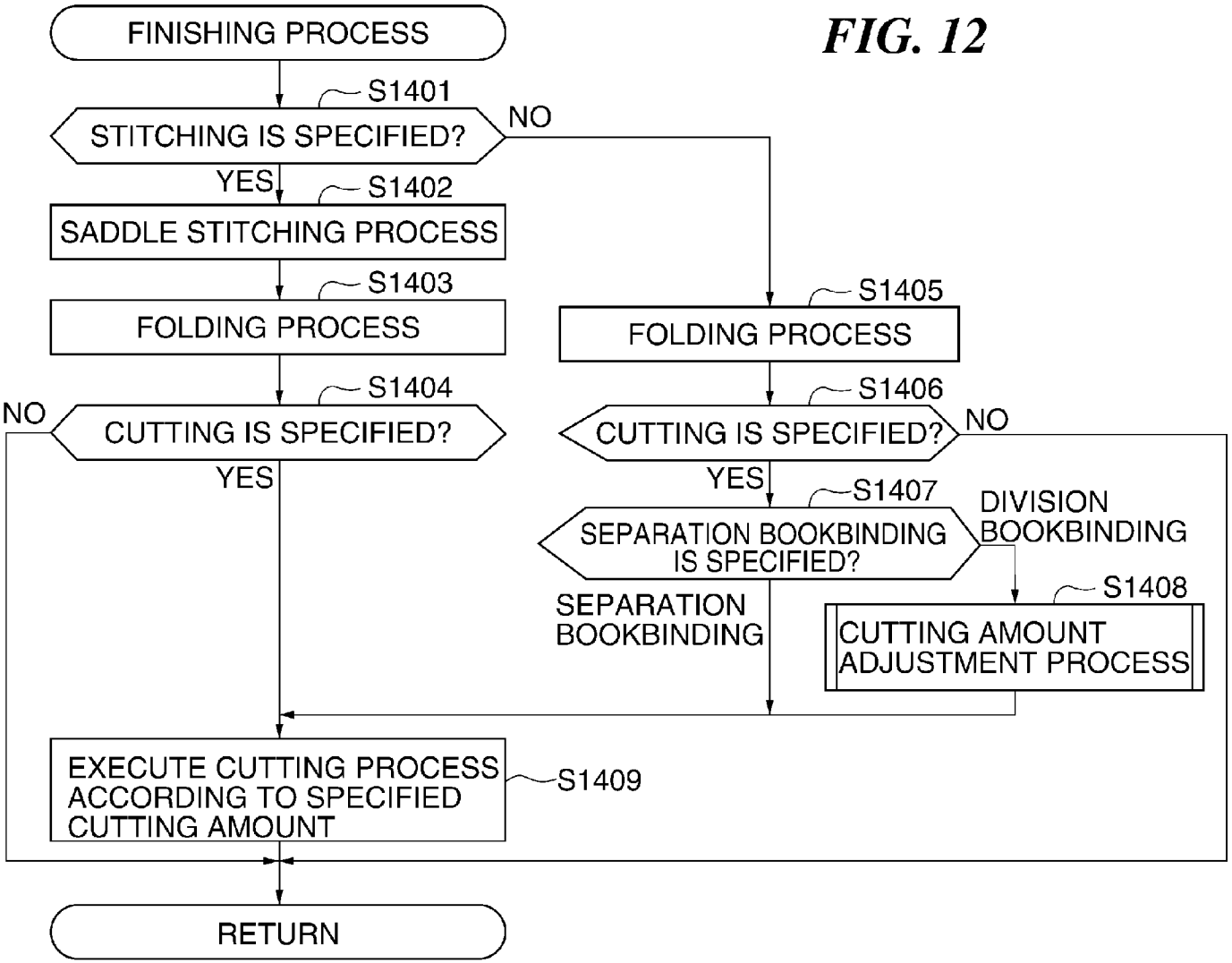
FIG. 12 is a flowchart showing details of a finishing process in the step S1210 in FIG. 10.

FIG. 12 is a flowchart showing details of the finishing process in the step S1210 in FIG. 10.

The print control module 360 determines whether there is a stitching specification (step S1401). When determining that there is a stitching specification, the print control module 360 performs the saddle stitching process that staples the center of a sheet bundle (step S1402) and the folding process (step S1403). On the other hand, when there is not a stitching specification, the process proceeds to step S1405.

In step S1404, the print control module 360 determines whether the cutting processing is specified. When the cutting process is specified, the process proceeds to step S1409. When the cutting process is not specified, the process returns. The steps S1401, S1404, S1406, and S1407 are examples of a bookbinding specification determination unit.

Figure 17A:
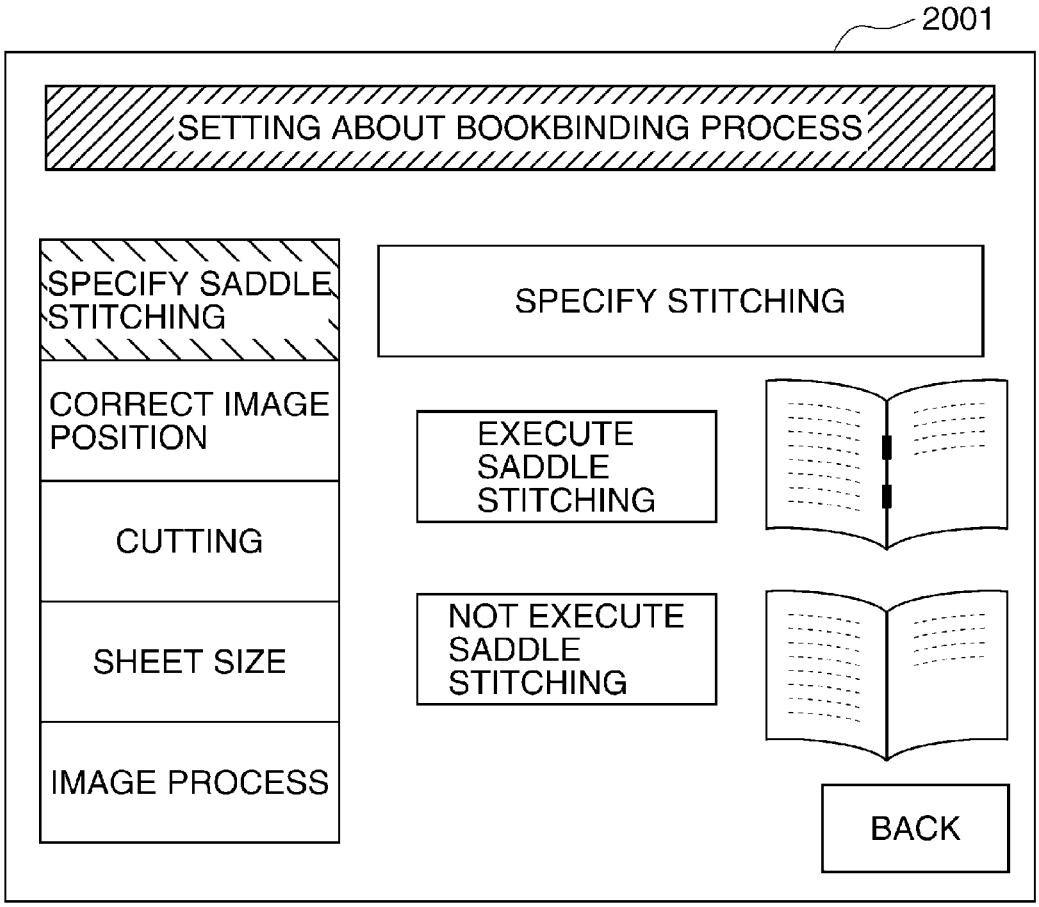
FIG. 17A through FIG. 17F are views showing examples of operation screens for setting the printing-bookbinding process in the first embodiment of the present invention.
Figure 17B:
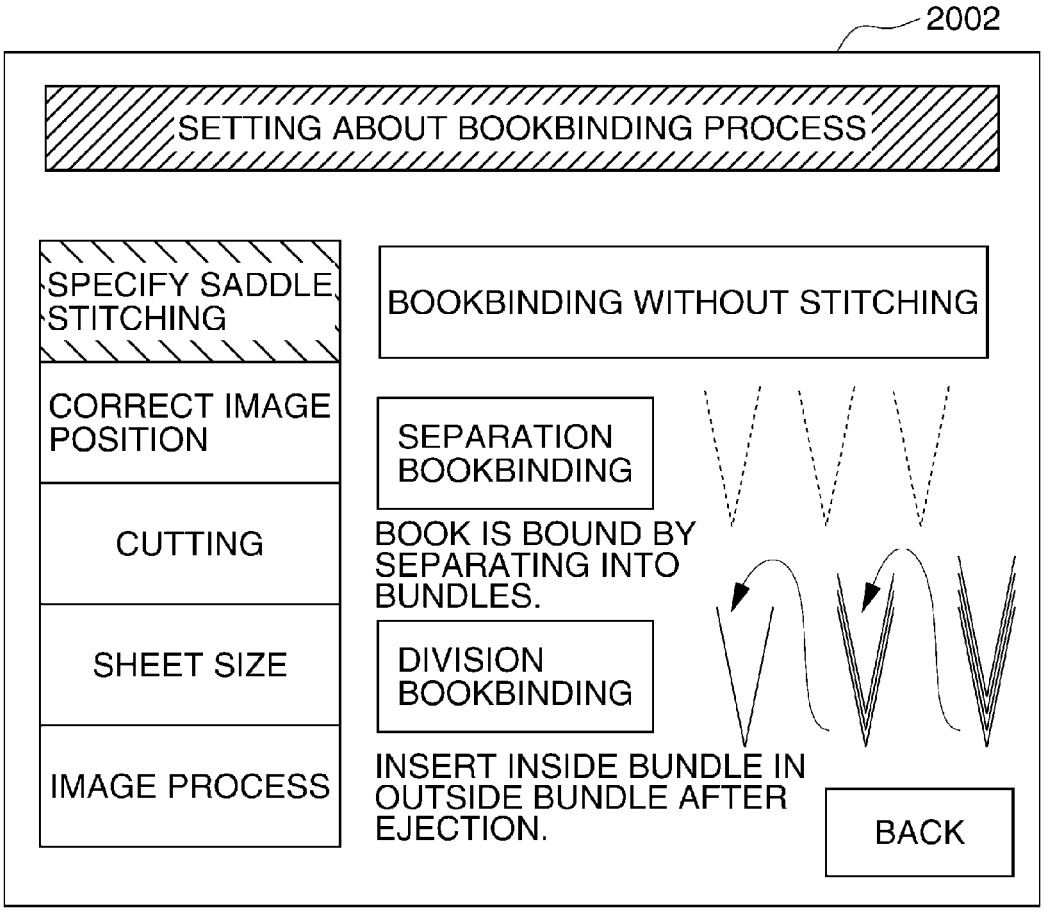
Figure 17C:
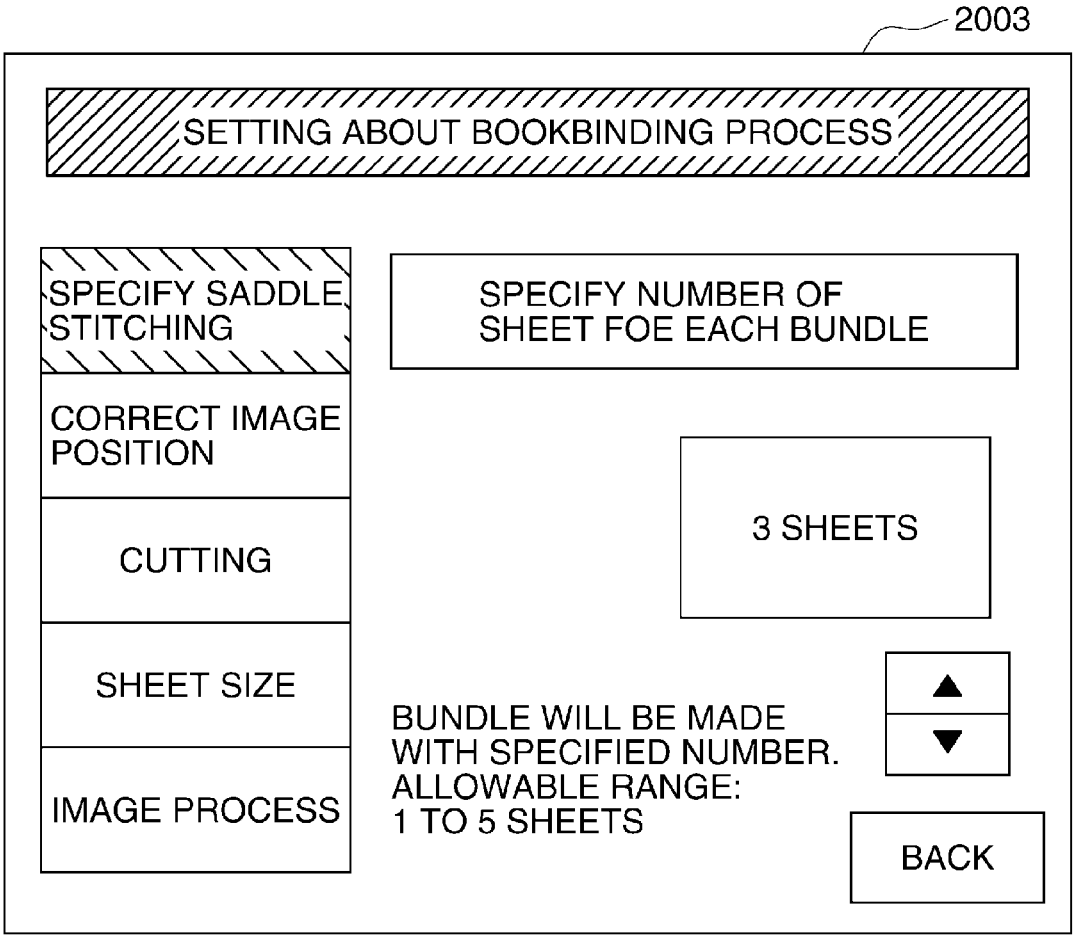
Figure 17D:
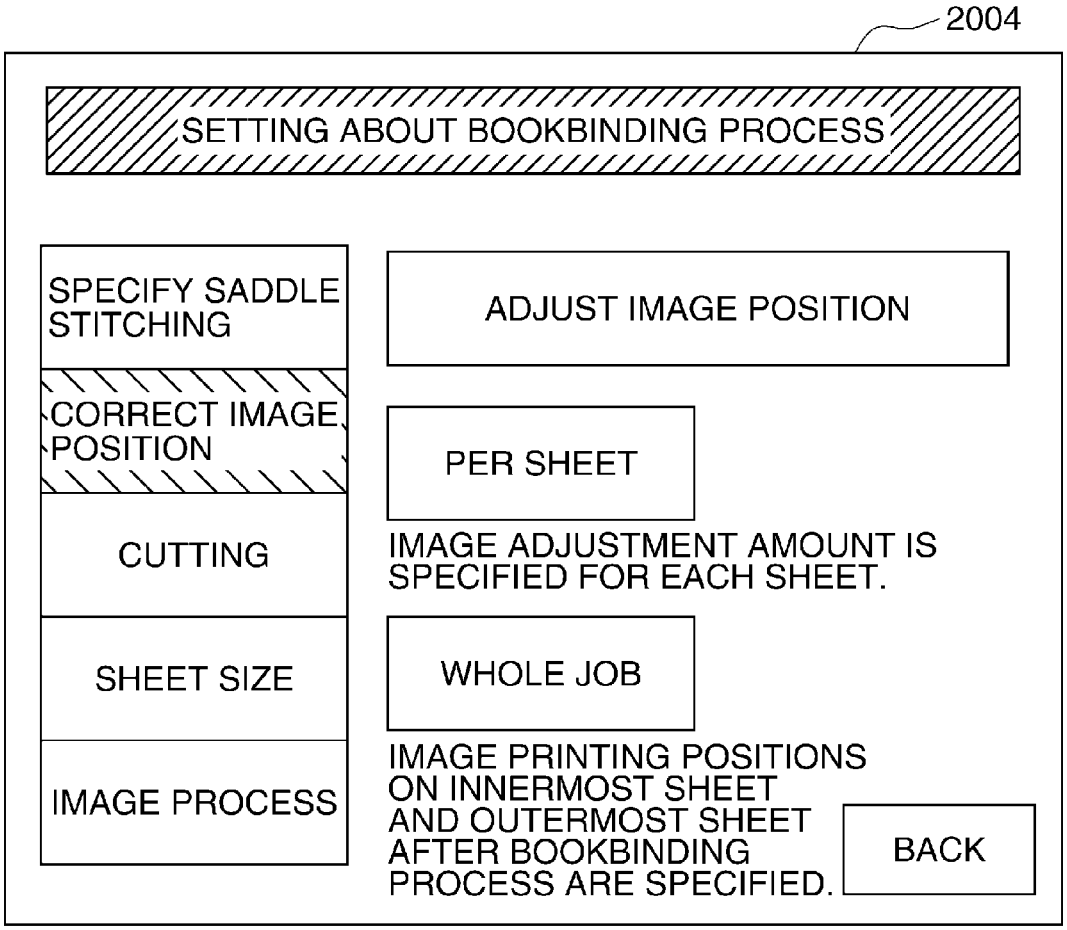
Figure 17E:
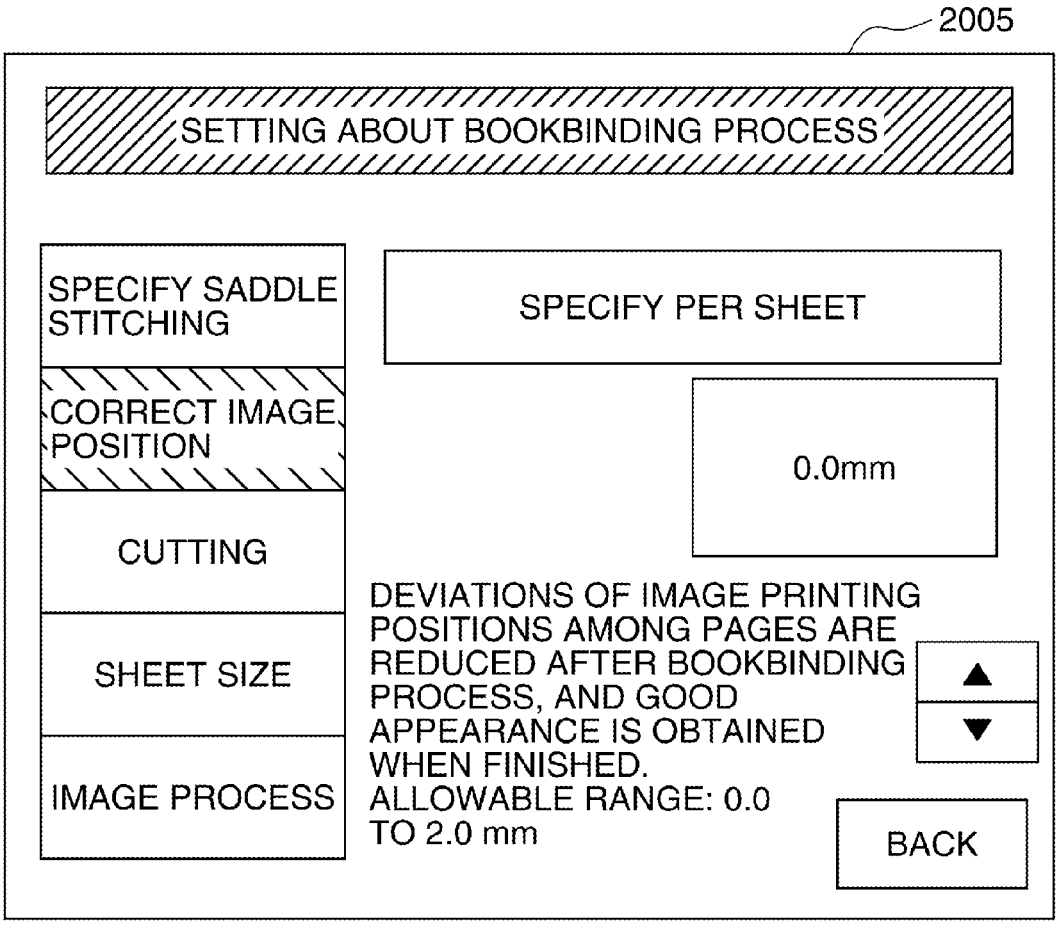
Figure 17F:
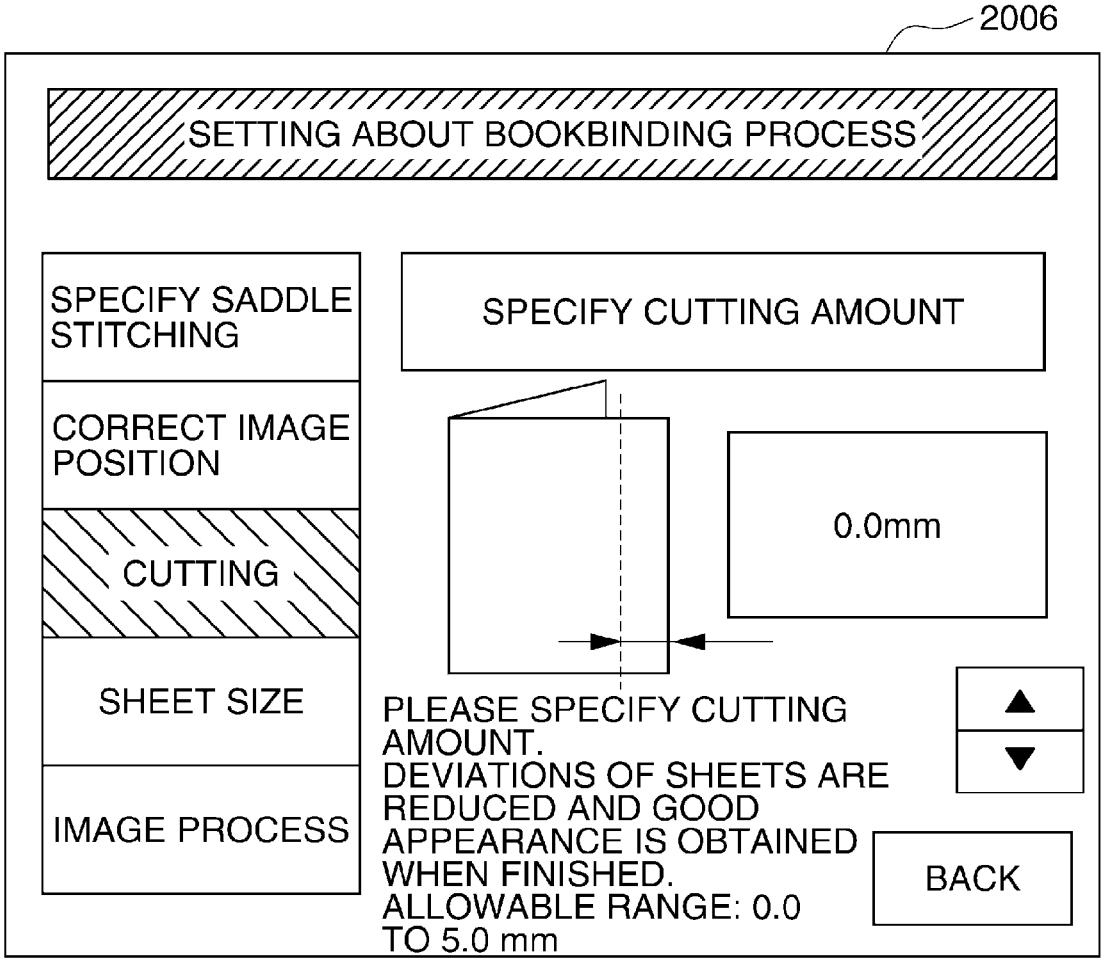

The cutting process is executed according to the cutting amount specified by a user on the operation screen 2006 shown in FIG. 17F, the operation screen 2201 shown in FIG. 19A, or the operation screen 2202 shown in FIG. 19B in the step S1409, and then, the process returns.

In the step S1405, the folding process is executed to a sheet bundle. Next, the print control module 360 determines whether the cutting process is specified (step S1406). When the cutting process is not specified, the process returns. On the other hand, when the cutting process is specified, the process proceeds to step S1407.

In the step S1407, the print control module 360 determines whether the separation bookbinding is specified. When the separation bookbinding is specified, the process proceeds to the step S1409. On the other hand, when the separation bookbinding is not specified (i.e., when the division bookbinding is specified), the process proceeds to step S1408. The process in the step S1407 is an example of a division bookbinding determination unit.

A cutting amount adjustment process is executed in the step S1408. Details of the cutting amount adjustment process will be described below. The step S1408 is an example of a cutting-adjustment-amount computation unit. After the cutting amount adjustment process is executed, the cutting process is executed (the step S1409) according to the cutting amount readjusted in the process concerned.

Figure 13A:
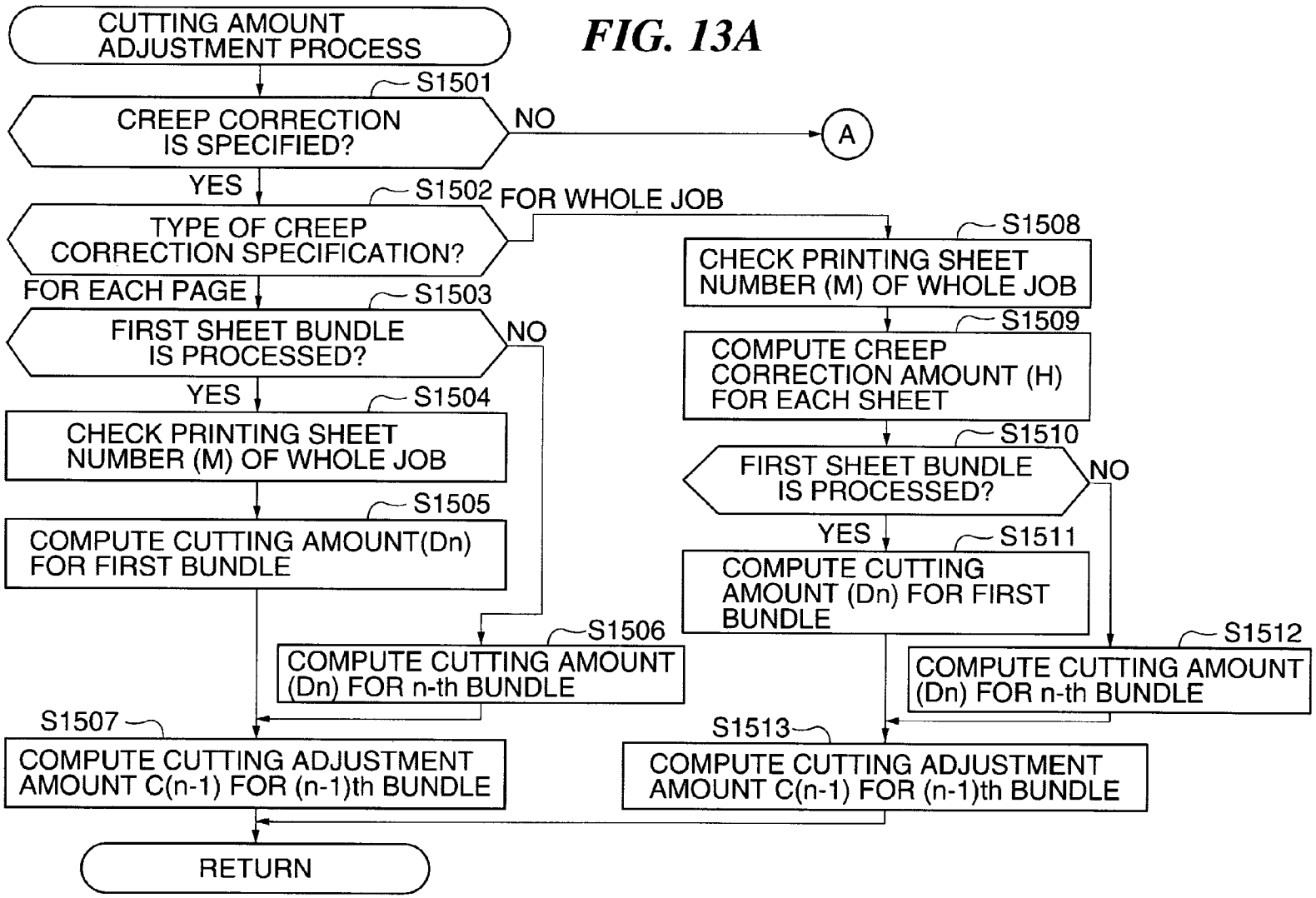
FIG. 13A is a flowchart showing details of a cutting amount adjustment process in the step S1408 in FIG. 12.

FIG. 13A is a flowchart showing details of the cutting amount adjustment process in the step S1408 in FIG. 12.

First, a creep-correction (image position compensation) function for correcting a printing position of an image is described.

Since a booklet is created by folding a plurality of sheets at once after the bookbinding printing process, the position of the image printed on the outermost sheet is deviated from the position of the image printed on the innermost sheet, if image positions are not corrected. This is because deviations occur due to the sheet thickness and an error in the accuracy of the folding function of the post-processing device. The image forming apparatus allows performing an adjustment process so that the printing position of each page matches with the printing position of the next page turned in order to improve accuracy of the finished booklet. This function is called a creep correction function. The creep correction function has a function that finely adjust a printing position of an image for every sheet, and a function that automatically adjust a printing position by the image forming apparatus based on specification of difference between the printing position of an image printed on the outermost sheet and that on the innermost sheet.

In FIG. 13A, the print control module 360 determines whether there is a creep correction specification (step S1501). When it is determined that there is not a creep correction specification, the process proceeds to step S1601 in FIG. 13B. It should be noted that the process shown in FIG. 13B will be described in a second embodiment. On the other hand, when it is determined that there is a creep correction specification in the step S1501, the process proceeds to step S1502.

In the step S1502, the print control module 360 determines the type of the creep correction specification. The type of the creep correction specification can be specified on the operation screen 2004 shown in FIG. 17D and the operation screen 2005 shown in FIG. 17E, for example. When it is determined that the individual creep correction amounts for the respective pages have been specified in the step S1502, the process proceeds to step S1503. On the other hand, when it is determined that the common creep correction amount for the whole job has been specified, the process proceeds to step S1508.

In the step S1503, the print control module 360 determines whether the first sheet bundle is currently processed. When determining that the first sheet bundle is processed, the print control module 360 checks the printing sheet number M of the whole job (step S1504). Subsequently, the print control module 360 computes a creep correction amount H based on the number of sheets needed to print, and then, computes the cutting amount Dn for the first sheet bundle (step S1505).

An example of an operation expression for computing the cutting amount Dn for the first sheet bundle is shown as follows.

$$Dn=M\cdot H$$

M: Number of sheets required in the printing process of a job

H: Creep correction amount

When determining that the sheet bundle other than the first sheet bundle is processed in the step S1503, the print control module 360 computes the cutting amount Dn by subtracting the cutting adjustment amount Cn for the n-th sheet bundle, which has been computed when the n-th sheet bundle has been processed, from the cutting amount for the (n−1)th sheet bundle (step S1506). The step S1506 is an example of a cutting amount computation unit.

An example of an operation expression for computing the cutting amount Dn for the n-th sheet bundle other than the first sheet bundle is shown as follows.

$$Dn=D(n+1)-Cn$$

In step S1507, the print control module 360 computes the cutting adjustment amount C(n−1) for the next sheet bundle (the (n−1)th sheet bundle). The step S1507 is an example of the cutting amount computation unit.

An example of an operation expression for computing the cutting amount of the (n−1)th sheet bundle is shown as follows.

$$C(n-1)=Mn\cdot H$$

Mn: Number of sheets in the n-th sheet bundle

H: Creep correction amount

In the step S1508, the print control module 360 checks the printing sheet number M of the sheets required for the printing process of the whole job. Next, the print control module 360 computes the creep correction amount H for each sheet based on the printing sheet number M and the specified creep correction amount (step S1509).

An example of an operation expression for finding the creep correction amount H for each sheet is shown as follows.

$$H=Hs/M$$

Hs: Creep correction amount specified by an operator

Next, the print control module 360 determines whether the first sheet bundle is currently processed (step S1510). When it is determined that the first sheet bundle is processed, the process proceeds to step S1511. On the other hand, when it is determined that the sheet bundle other than the first sheet bundle is processed in the step S1510, the process proceeds to step S1512.

In step S1511, the print control module 360 computes the cutting amount Dn for the first sheet bundle from the creep correction amount H computed in the step S1509 based on the printing sheet number M required to print and the specified creep correction amount.

An example of an operation expression for computing the cutting amount Dn for the first sheet bundle is shown as follows.

$$Dn=M\cdot H$$

M: Number of sheets required in the printing process of a job

H: Creep correction amount

In the step S1512, the print control module 360 computes the cutting amount Dn by subtracting the cutting adjustment amount Cn for the n-th sheet bundle, which has been computed when the n-th sheet bundle has been processed, from the cutting amount for the (n−1)th sheet bundle. The step S1512 is an example of the cutting amount computation unit.

An example of an operation expression for computing the cutting amount Dn for the n-th sheet bundle other than the first sheet bundle is shown as follows.

$$Dn=D(n+1)-Cn$$

In step S1513, the print control module 360 computes the cutting adjustment amount Cn for the next sheet bundle (the (n−1)th sheet bundle). The step S1513 is an example of the cutting amount computation unit.

An example of an operation expression for computing the cutting amount for the first sheet bundle is shown as follows.

$$C(n-1)=Mn\cdot H$$

Mn: Number of printing sheets in the n-th sheet bundle

H: Creep correction amount

After the cutting amount correction process is executed as mentioned above, the process returns the finishing process in FIG. 12. And then, a booklet is completed by executing the cutting process in the step S1409. An example of the printed matter in the case of the division bookbinding is shown in FIG. 9A.

A division process is applied to sheets of an inputted job according to the upper limit of sheet number that can be processed by the post-processing device or the sheet number specified by the operator. Each of the sheet bundles 1001 is formed by applying an imposition process and a printing process to the divided sheets, and by gathering the processed sheets and folding them in half.

Furthermore, the printed matter 1003 is completed because an operator inserts an sheet bundle in an outside sheet bundle after applying the cutting process to the sheet bundles according to the cutting amounts that are adjusted in the cutting amount adjustment process (dotted lines show cutting positions 1002 in the illustrated example).

According to this embodiment, the cutting amount for each sheet bundle can be adjusted based on the type of the separation method and the creep correction amount. This allows an operator to execute the cutting amount adjustment process for each sheet bundle without considering dividing positions of a job and a layout process for each page.

Next, a second embodiment of the present invention will be described. In the second embodiment, the process executed when it is determined that the creep correction is not specified in the step S1501 in FIG. 13A will be described. The same reference number is attached to the same element as that in the first embodiment, and the duplicated description is omitted. Hereafter, only points different from the first embodiment will be described.

Figure 13B:
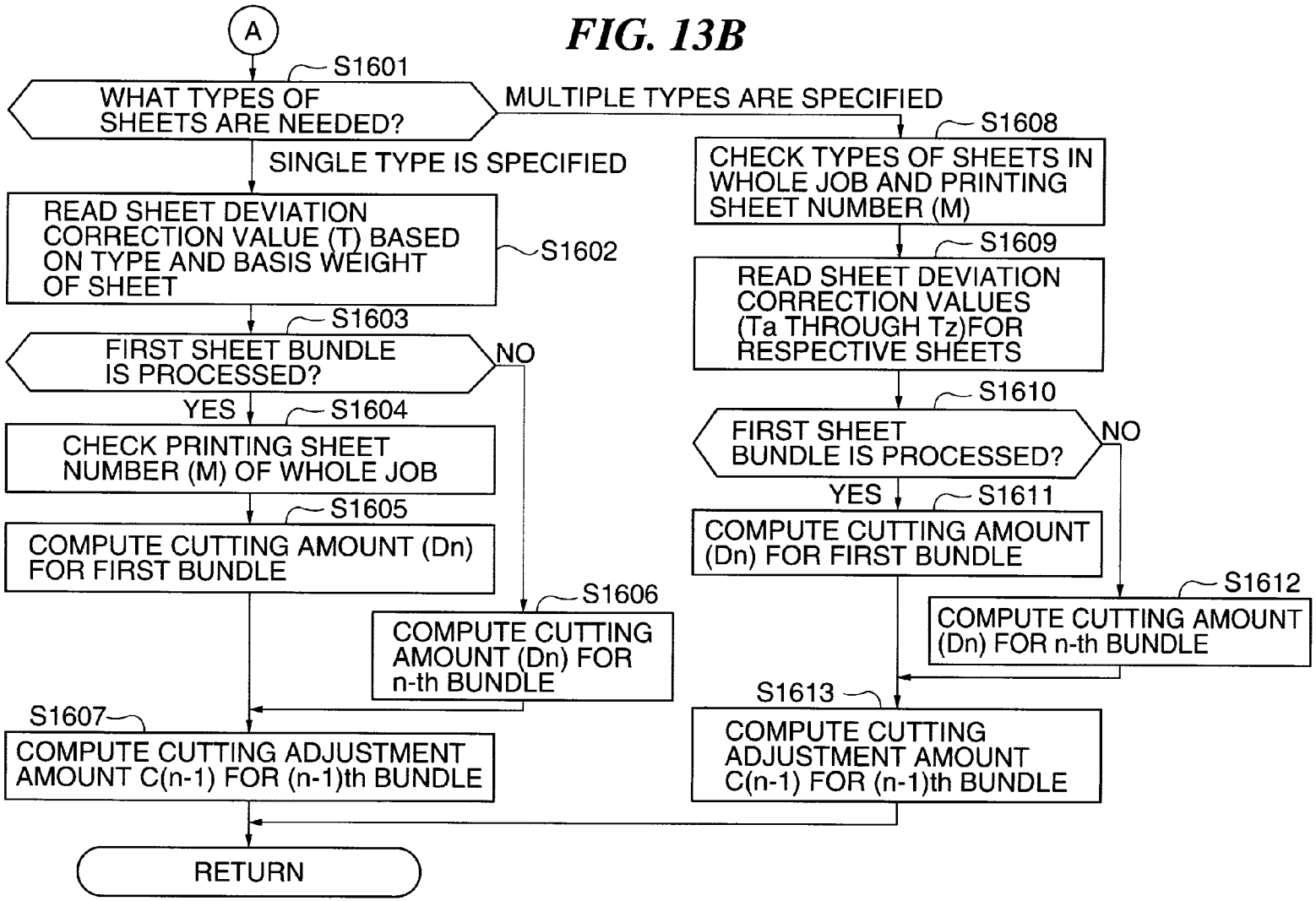
FIG. 13B is a flowchart showing a cutting amount adjustment process according to a second embodiment of the present invention.

FIG. 13B is a flowchart showing a cutting amount adjustment process according to the second embodiment of the present invention.

The print control module 360 determines the types of sheets that are needed in the printing process of the job (step S1601). When it is determined that all the sheets that are needed in the printing process of the job are specified as the same type, the process proceeds to step S1602. On the other hand, when it is determined that a plurality of types are specified, the process proceeds to step S1608. The process in the step S1601 is an example of a sheet type determination unit.

In the step S1602, the print control module 360 reads a sheet deviation correction value T corresponding to the type of the sheet based on the type and basis weight of the sheet that is used in the printing process (step S1602). The sheet deviation correction value T is saved beforehand in the HDD 208 etc. The process in the step S1602 is an example of a sheet-deviation-correction-value reading unit.

Next, the print control module 360 determines whether the first sheet bundle is currently processed (step S1603). When determining that the first sheet bundle is processed, the print control module 360 checks the printing sheet number M of the whole job (step S1604). Subsequently, the print control module 360 computes a sheet deviation correction value T based on the number of sheets needed to print, and then, computes the cutting amount Dn for the first sheet bundle (step S1605).

An example of an operation expression for computing the cutting amount Dn for the first sheet bundle is shown as follows.

$$Dn=M\cdot T$$

M: Number of sheets required in the printing process of a job

T: Sheet deviation correction value corresponding to a sheet type

When determining that the sheet bundle other than the first sheet bundle is processed in the step S1603, the print control module 360 computes the cutting amount Dn by subtracting the cutting adjustment amount Cn for the n-th sheet bundle, which has been computed when the n-th sheet bundle has been processed, from the cutting amount for the (n−1)th sheet bundle (step S1605).

An example of an operation expression for computing the cutting amount Dn for the n-th sheet bundle other than the first sheet bundle is shown as follows.

$$Dn=D(n+1)-Cn$$

In step S1607, the print control module 360 computes the cutting adjustment amount Cn of the next sheet bundle (the (n−1)th sheet bundle).

An example of an operation expression for computing the cutting adjusting amount for the (n−1)th sheet bundle is shown as follows.

$$C(n-1)=Mn\cdot T$$

Mn: Number of printing sheets in the n-th sheet bundle

T: Sheet deviation correction value

In the step S1608, the print control module 360 checks the types of sheets used in the whole job and the printing sheet number M. Next, the print control module 360 checks the sheet deviation correction values Ta through Tz for the respective sheets based on the sheet types and basis weights used in the printing process (step S1609). The sheet deviation correction values Ta through Tz for the respective sheets are saved beforehand in the HDD 208 etc. The step S1609 is an example of the sheet-deviation-correction-value reading unit.

Next, the print control module 360 determines whether the first sheet bundle is currently processed (step S1610). When it is determined that the first sheet bundle is processed, the process proceeds to step S1611. On the other hand, when it is determined that the sheet bundle other than the first sheet bundle is processed in the step S1610, the process proceeds to step S1612.

In the step S1611, the print control module 360 computes the cutting amount Dn for the first sheet bundle based on the types of all the sheets used in the printing process and the printing sheet number M.

An example of an operation expression for computing the cutting amount Dn for the first sheet bundle is shown as follows.

$$Dn=Ma\cdot Ta+Mb\cdot Tb+\ldots+Mz\cdot Tz$$

Ma, Mb, . . . , Mz: The number of sheets of sheet types A through Z that constitute a job Ta, Tb, . . . , Tz: Sheet deviation correction values for the respective sheet types computed based on the sheet types and basis weights of sheets In the step S1612, the print control module 360 computes the cutting amount Dn by subtracting the cutting adjustment amount Cn for the n-th sheet bundle, which has been computed when the n-th sheet bundle has been processed, from the cutting amount for the (n−1)th sheet bundle.

An example of an operation expression for computing the cutting amount Dn for the n-th sheet bundle other than the first sheet bundle is shown as follows.

$$Dn=D(n+1)-Cn$$

In step S1613, the print control module 360 computes the cutting adjustment amount Cn of the next sheet bundle (the (n−1)th sheet bundle).

An example of an operation expression for computing the cutting adjusting amount for the (n−1)th sheet bundle is shown as follows.

$$C(n-1)=Ga\cdot Ta+Gb\cdot Tb+\ldots+Gz\cdot Tz$$

Ga, Gb, . . . , Gz: The number of sheets of sheet types A through Z in the n-th sheet bundle Ta, Tb, . . . , Tz: Sheet deviation correction values for the respective sheet types A through Z After the cutting amount correction process is executed as mentioned above, the process returns the finishing process in FIG. 12. And then, a booklet is completed by executing the cutting process in the step S1409.

According to this embodiment, the cutting amount for each sheet bundle can be adjusted by computing the cutting adjustment amount based on the separation method, the sheet type and the basis weight of sheets used to print. This allows an operator to execute the cutting amount adjustment process for each sheet bundle without considering dividing positions of a job and a layout process for each page.

Next, a third embodiment of the present invention will be described. In the third embodiment, a process when the cutting amount exceeding the ability of the post-processing device is specified in the printing system described in the above-mentioned first and second embodiments will be described with reference to FIG. 14. Furthermore, a process when the cutting amount exceeds a margin that defines a region where no image is printed will be described with reference to FIG. 15. The same reference number is attached to the same element as that in the first embodiment, and the duplicated description is omitted. Hereafter, only points different from the first embodiment will be described.

Figure 14:
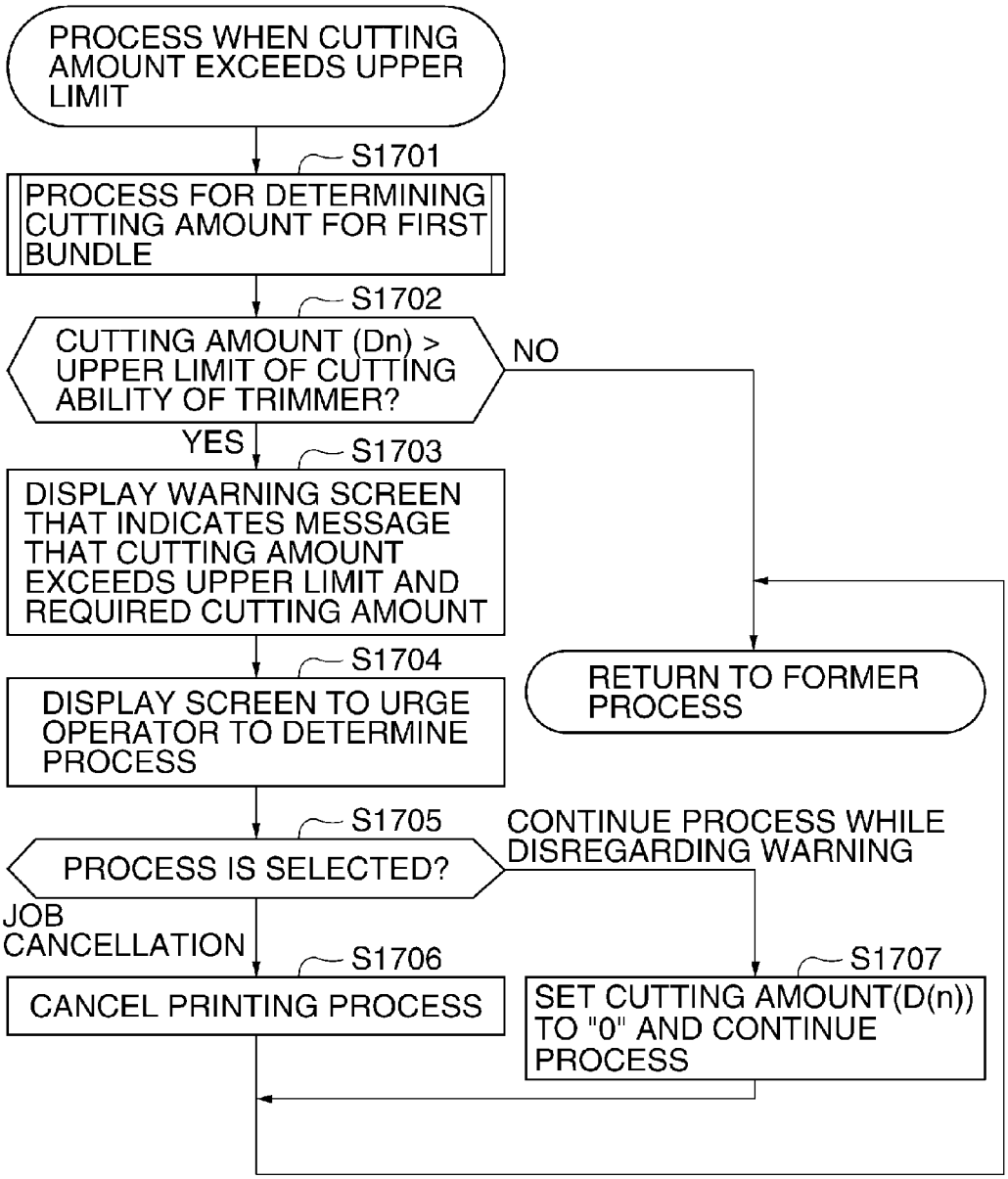
FIG. 14 is a flowchart showing a process according to a third embodiment of the present invention when a specified cutting amount exceeds ability of a post-processing device.

FIG. 14 is a flowchart showing a process according to the third embodiment of the present invention when a specified cutting amount exceeds ability of the post-processing device.

Step S1701 in FIG. 14 corresponds to the process for computing the cutting amount Dn for the first sheet bundle as shown in the steps S1505 and S1511 in FIG. 13A, and the steps S1605 and S1611 in FIG. 13B. The following process is performed after one of these steps.

In step S1702, the print control module 360 determines whether the cutting amount Dn computed in the step S1701 is larger than the upper limit of the cutting ability of the post-processing device (trimmer). The step S1702 is an example of a cutting-upper-limit determination unit. When it is determined that the cutting amount Dn does not exceed the upper limit, the process returns to the step S1507 or S1513 in FIG. 13A, or the step S1607 or S1613 in FIG. 13B. On the other hand, when it is determined that the cutting amount Dn exceeds the upper limit, the touch panel section 801 displays a warning screen (not shown) that indicates a message that the cutting amount exceeds the upper limit and a required cutting amount (step S1703). The step S1703 is an example of a warning display unit.

Furthermore, a screen (not shown) to urge an operator to select whether the process for the job is continued or not is displayed on the touch panel section 801 (step S1704), and a selection by the operator is waited (step S1705). When the operator selects a job cancellation, the print control module 360 interrupts the printing process, and executes a job cancellation process (step S1706). On the other hand, when the operator selects to continue the process while disregarding the warning, the print control module 360 sets the cutting amount Dn to "0" to prohibit the cutting process (step S1707). Then, the process returns to the former process, i.e., the step S1507 or S1513 in FIG. 13A, or the step S1607 or S1613 in FIG. 13B.

Figure 15:
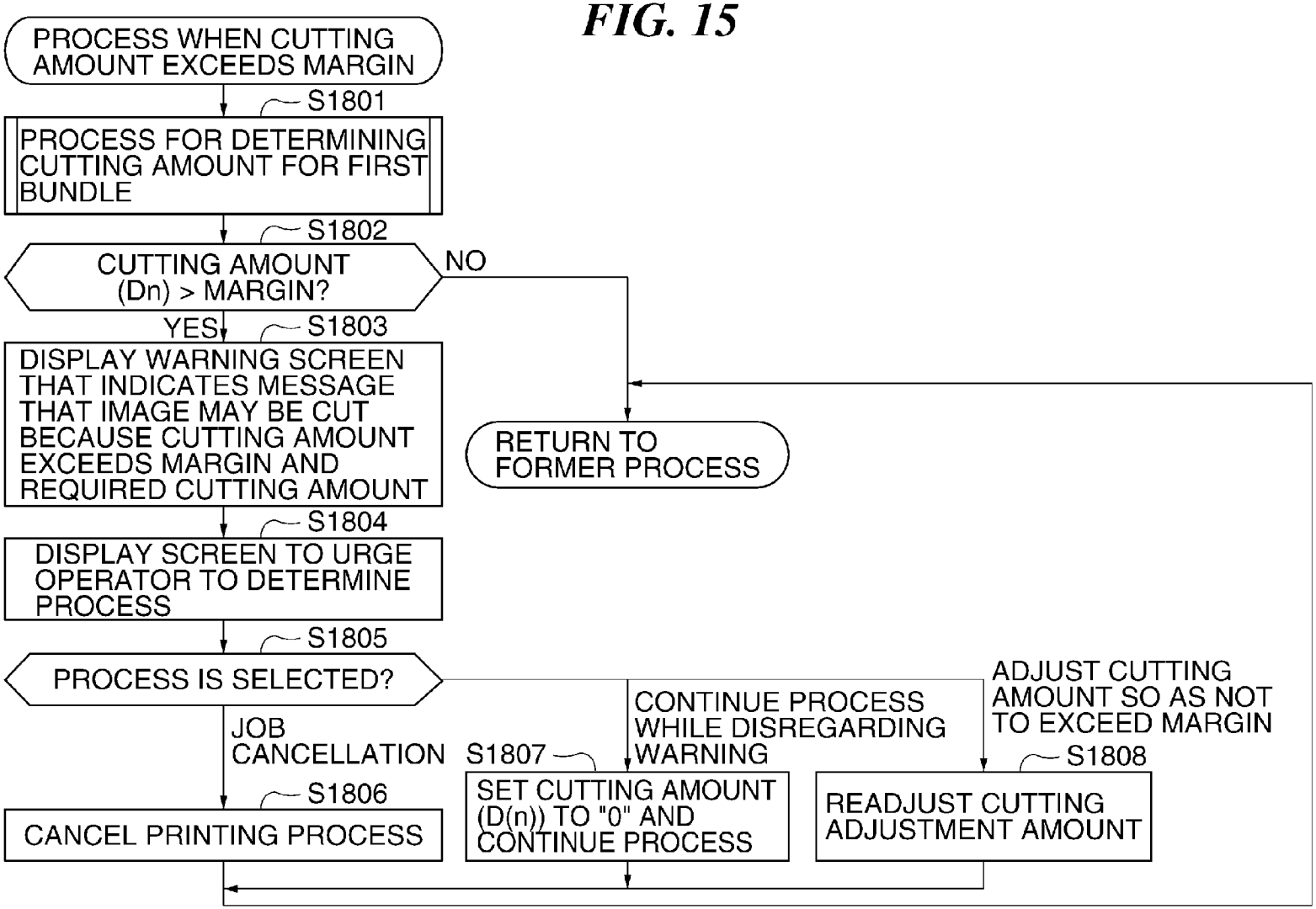
FIG. 15 is a flowchart showing a process according to the third embodiment of the present invention when a computed cutting amount exceeds a margin that defines a region where no image is printed.

FIG. 15 is a flowchart showing a process according to the third embodiment of the present invention when a computed cutting amount exceeds a margin that defines a region where no image is printed.

Step S1801 in FIG. 15 corresponds to the process for computing the cutting amount Dn for the first sheet bundle as shown in the steps S1505 and S1511 in FIG. 13A, and the steps S1605 and S1611 in FIG. 13B. The following process is performed after one of these steps.

In step S1802, the print control module 360 determines whether the cutting amount Dn computed in the step S1801 is larger than the margin that is computed when the printing process is applied to the image. The step S1802 is an example of a margin determination unit. When it is determined that the cutting amount Dn does not exceed the margin, the process returns to the step S1507 or S1513 in FIG. 13A, or the step S1607 or S1613 in FIG. 13B. On the other hand, when it is determined that the cutting amount Dn exceeds the margin and that the area where the image is printed may be cut out, the progress proceeds to step S1803.

In the step S1803, the touch panel section 801 displays a warning screen (not shown) that indicates a message that the image specified to print may be cut because the specified cutting amount exceeds the margin and a required cutting amount. The step S1803 is an example of a warning display unit.

Furthermore, a screen (not shown) to urge an operator to select whether the process for the job is continued or not is displayed on the touch panel section 801 (step S1804), and a selection by the operator is waited (step S1805). When the operator selects a job cancellation, the print control module 360 interrupts the printing process, and executes a job cancellation process (step S1806).

On the other hand, when the operator selects to continue the process while disregarding the warning, the print control module 360 sets the cutting amount Dn to "0" to prohibit the cutting process (step S1807). Furthermore, when the operator selects a process for readjusting the cutting amount so as not to cut an image area and not to exceed the margin, the print control module 360 readjusts a cutting adjustment amount so that a cutting amount does not exceed the margin (step S1808). Then, the process returns to the former process, i.e., the step S1507 or S1513 in FIG. 13A, or the step S1607 or S1613 in FIG. 13B.

According to this embodiment, failure cost about booklet making can be reduced by controlling not to perform a cutting process, when the specified cutting amount exceeds the ability of the post-processing device or exceeds a margin. Moreover, since the operator can obtain a printed matter to which only the creep correction is applied without applying a cutting process, the operator can apply only a cutting process to a booklet using a cutting device with high performance if needed.

Next, a fourth embodiment of the present invention will be described. In the fourth embodiment, a process using a printing system in which an image forming apparatus and a post-processing device are connected to a near-line finisher through a network or a dedicated line will be described with reference to FIG. 16.

Figure 16:
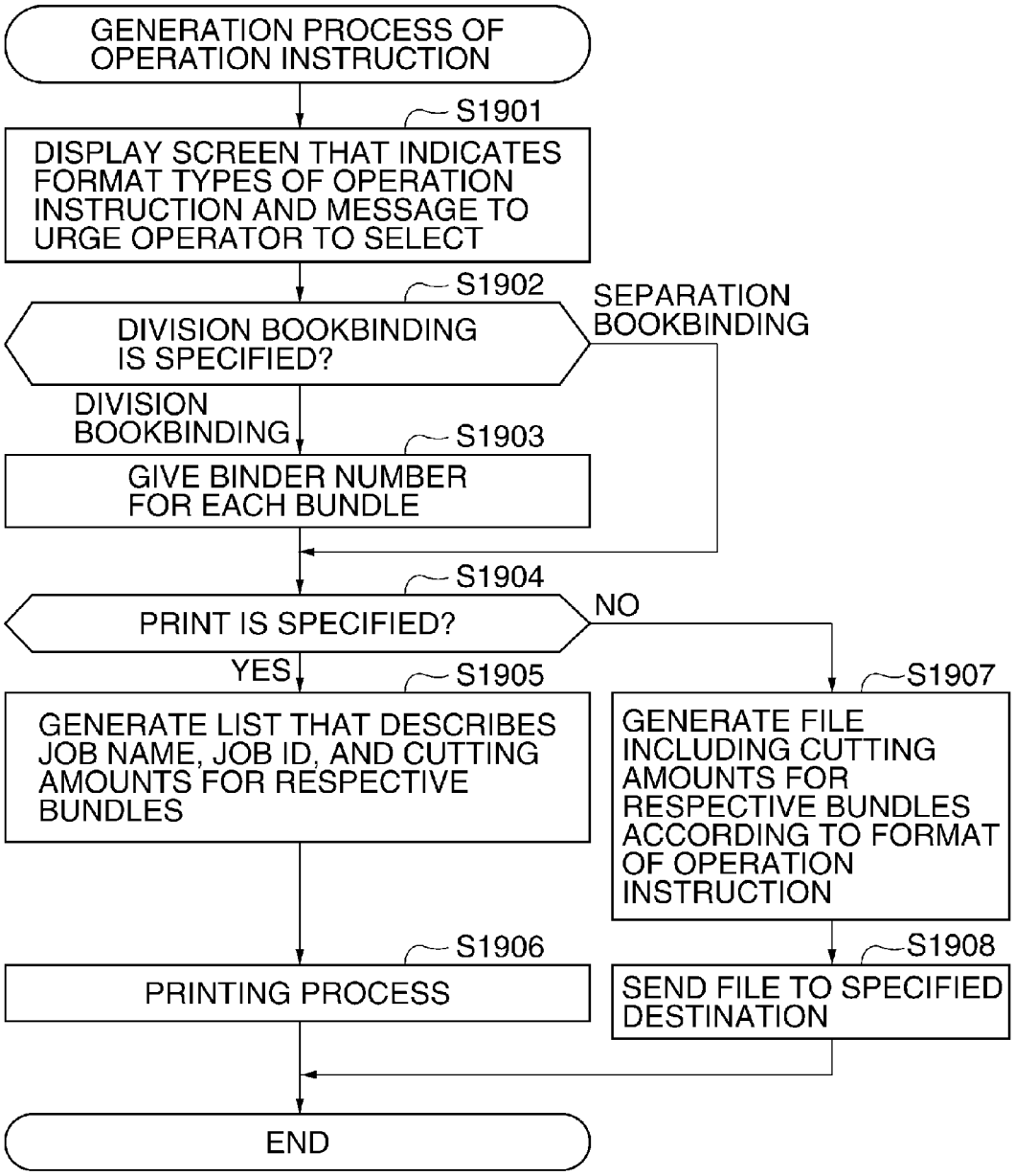
FIG. 16 is a flowchart showing a generation process of an operation instruction for operating a near-line finisher in a fourth embodiment of the present invention.

FIG. 16 is a flowchart showing a generation process of an operation instruction for operating a near-line finisher.

The generation process of an operation instruction for operating a near-line finisher can be performed in the finishing process in the step S1210 in FIG. 10.

As shown in FIG. 16, the print control module 360 displays a screen that indicates format types of an operation instruction that can be generated by the printing system 75 alone and a message to urge an operator to select a format type of an operation instruction on the touch panel section 801 (step S1901).

Next, the print control module 360 determines whether the division bookbinding is specified or whether the separation bookbinding is specified (step S1902). When it is determined that the division bookbinding was specified, the process proceeds to step S1903. On the other hand, when it is determined that the separation bookbinding is specified, the process proceeds to step S1904 without giving a binder number.

In the step S1903, the print control module 360 gives a binder number to each sheet bundle. The step S1903 is an example of a binder numbering unit.

In the step S1904, the print control module 360 determines whether the print of the operation instruction is specified in the step S1901. When it is determined that the print is specified, the process proceeds to step S1905. On the other hand, when it is selected to generate an operation instruction as an electronic file, the process proceeds to step S1907.

The print control module 360 generates a list that describes a job name of a job under processing, a job ID, and cutting amounts for respective sheet bundles in the step S1905, and then, proceeds with the process to step S1906 to perform the printing process.

In the step S1907, the print control module 360 generates a file, which includes information about the job name, the job ID, and the cutting amounts for respective sheet bundles, in the format (for example, JDF, PrintTicket) selected in the step S1901. Next, the operation instruction generated in the step S1907 is sent to a destination specified beforehand (for example, the near-line finisher, the host computer set up so as to operate the near-line finisher) in step S1908.

According to this embodiment, the operation instruction for the near-line finisher, which is not directly connected with the image forming apparatus, can be generated.

Although the control program shall run on the image forming apparatus (or the post-processing device) in the above-mentioned first through fourth embodiments, it is also possible to constitute so that the control program runs on the print server 71, the host computer 72 or 73.

Furthermore, the invention can be embodied as a system, an apparatus, a method, a program, a storage medium, etc. Specifically, the present invention can be applied to a system that consists of a plurality of devices, or to an apparatus that consists of a single device.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-265174, filed on Dec. 4, 2012, which is hereby incorporated by reference herein in its entirety.

What is claimed is:

1. A printing system comprising:

a determination unit configured to determine whether it is specified so that images are printed on sheets of first and second sheet bundles in page order in which a bookbound matter is produced by covering the second sheet bundle folded with the first sheet bundle folded; and a control unit configured to control so as to cut the first sheet bundle at a first position and to cut the second sheet bundle at a second position that is different from the first position, when said determination unit determines to be specified.

2. The printing system according to claim 1, wherein said control unit controls so as to cut the first sheet bundle at the first position and to cut the second sheet bundle at the first position, when said determination unit determines not to be specified.

3. The printing system according to claim 1, wherein said control unit controls so as to cut the first sheet bundle at the first position and to cut the second sheet bundle at the first position, when it is specified so that images are printed on sheets of the first and second sheet bundles in page order in which a bookbound matter is produced by adjoining the first sheet bundle to the second sheet bundle.

4. The printing system according to claim 1, further comprising:

a layout unit configured to lay out images to the sheets of the first and second sheet bundles in page order in which a bookbound matter is produced by covering the second sheet bundle with the first sheet bundle, when said determination unit determines to be specified.

5. The printing system according to claim 1, further comprising:

a decision unit configured to decide whether it is specified so as to stitch the first sheet bundle and the second sheet bundle respectively, wherein said control unit controls so as to cut the first sheet bundle at the first position and to cut the second sheet bundle at the first position regardless of the determination by said determination unit, when said decision unit decides that it is specified so as to stitch the first sheet bundle and the second sheet bundle respectively.

6. A control method for a printing system comprising:

determining whether it is specified so that images are printed on sheets of first and second sheet bundles in page order in which a bookbound matter is produced by covering the second sheet bundle folded with the first sheet bundle folded; and controlling so as to cut the first sheet bundle at a first position and to cut the second sheet bundle at a second position that is different from the first position, when determining to be specified.

7. A non-transitory computer-readable storage medium storing a control program causing a computer to execute a control method for a printing system, the program comprising:

a code for determining whether it is specified so that images are printed on sheets of first and second sheet bundles in page order in which a bookbound matter is produced by covering the second sheet bundle folded with the first sheet bundle folded; and a code for controlling so as to cut the first sheet bundle at a first position and to cut the second sheet bundle at a second position that is different from the first position, when determining to be specified.

* * * * *